US007505057B2

(12) United States Patent
Yoshida

(10) Patent No.: US 7,505,057 B2
(45) Date of Patent: Mar. 17, 2009

(54) APPARATUS, METHOD, AND PROGRAM FOR COLOR IMAGE FORMING CAPABLE OF EFFICIENTLY CORRECTING DISPLACEMENT

(75) Inventor: Yoshiki Yoshida, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 508 days.

(21) Appl. No.: 11/290,644

(22) Filed: Dec. 1, 2005

(65) Prior Publication Data

US 2006/0139433 A1 Jun. 29, 2006

(30) Foreign Application Priority Data

Dec. 1, 2004 (JP) ..... 2004-348702
Jan. 7, 2005 (JP) ..... 2005-002621
Sep. 1, 2005 (JP) ..... 2005-253577

(51) Int. Cl.
*B41J 2/42* (2006.01)
*G03G 15/01* (2006.01)

(52) U.S. Cl. ..... 347/116; 399/301

(58) Field of Classification Search ..... 347/116; 399/301, 394

See application file for complete search history.

(56) References Cited

U.S. PATENT DOCUMENTS 5,995,802 A * 11/1999 Mori et al. ..... 399/394
6,219,517 B1 * 4/2001 Takahashi et al. ..... 399/301

FOREIGN PATENT DOCUMENTS

| | | | |
|---|---|---|---|
| JP | H01-142680 | | 6/1989 |
| JP | 06-253151 | | 9/1994 |
| JP | 06253151 | * | 9/1994 |
| JP | H09-274418 | | 10/1997 |
| JP | 11-102098 | | 4/1999 |
| JP | 2001-051478 | | 2/2001 |
| JP | 2003-182146 | | 7/2003 |
| JP | 2003-316102 | | 11/2003 |
| JP | 2004-098593 | | 4/2004 |

* cited by examiner

*Primary Examiner*—Stephen D Meier
*Assistant Examiner*—Carlos A Martinez, Jr.
(74) *Attorney, Agent, or Firm*—Oblon, Spivak, McClelland, Maier & Neustadt, P.C.

(57) ABSTRACT

A color image forming apparatus includes a pattern forming mechanism configured to form a pattern for fine adjustment and a pattern for rough adjustment on a transfer medium, a detection mechanism configured to detect the pattern formed thereon, a displacement calculation mechanism configured to obtain a predetermined value and preset reference values, to calculate the amount of displacement based on the detected pattern and the preset reference values, and to determine whether or not the amount of the displacement is equal to or less than the predetermined value, and a displacement correction mechanism configured to correct the displacement based on the calculation.

18 Claims, 22 Drawing Sheets

| FIG. 21A |
| --- |
| FIG. 21B |

APPARATUS, METHOD, AND PROGRAM FOR COLOR IMAGE FORMING CAPABLE OF EFFICIENTLY CORRECTING DISPLACEMENT

BACKGROUND OF THE INVENTION

1. Field of the Invention

The present invention relates to an apparatus and a method for color image forming, and a program for the apparatus and the method, and more particularly to an apparatus and a method for color image forming capable of efficiently correcting displacement of an image in each of a plurality of colors, and a program for causing the apparatus to perform the method.

2. Discussion of the Background

In a conventional color image forming apparatus including four image forming devices, a full color image is formed by superimposing four toner images, each formed in one of four colors, by using one of the four image forming devices corresponding to the color.

When a full color image is formed, at least one of four toner images corresponding to one of the four colors may be out of color registration. When one of the four toner images in a corresponding color is displaced, for example, the displacement of the toner image in the color is corrected as described below.

When the toner image is displaced in a main scanning direction, the displacement of the toner image is corrected by logic control of the number of dots. Specifically, the amount of the displacement is measured, and the displacement is adjusted based on the amount of the displacement obtained by the measurement. In the adjustment, the amount of displacement is converted to a unit of dots. Then, a position in which a toner image in the color is to be formed is adjusted by the number of dots converted from the amount of displacement. By using the above method, adjustment with precision of 2 dots or less has been achieved.

Accordingly, when the toner image is displaced in a sub-scanning direction, the displacement of the toner image is corrected by logic control of the number of lines. Specifically, the amount of the displacement is measured, and the displacement is adjusted based on the amount of the displacement obtained by the measurement. In the adjustment, the amount of displacement is converted to a unit of lines. Then a position in which a toner image in the color is to be formed is adjusted by the number of lines converted from the amount of displacement. By using the above method, adjustment with precision of 2 lines or less has been achieved.

In general, when a color image forming apparatus is in practical use, displacement of a toner image in a corresponding one of a plurality of colors occurs over time. When a part of a laser optical system, an image forming unit, or the like is replaced, or maintenance is performed by disassembling the apparatus, the amount of displacement is significantly changed from an initial value. The amount of displacement after such maintenance is large compared with the amount of displacement observed in a normal operation. Therefore, measuring the amount of displacement before operation every time by using the same pattern results in a lack of precision, and the measurement may be ineffective.

A technology for correcting displacement to address the lack of precision has been disclosed. In a case of a color image forming apparatus automatically adjusting color registration, a pattern for measurement is formed as a unit of measurement, and the amount of displacement of an image in each of a plurality of colors is measured as a unit by using the pattern.

Then, when the amount of displacement is large as in the case of displacement after the maintenance, the displacement is manually corrected. Alternatively, rough adjustment is firstly performed, and then fine adjustment is performed.

SUMMARY OF THE INVENTION

This patent specification describes an apparatus and a method for color image forming capable of efficiently correcting displacement of an image in each of a plurality of colors. The color image forming apparatus includes a pattern forming mechanism configured to form a pattern for fine adjustment and, as necessary, a pattern for rough adjustment on a transfer medium, a detection mechanism configured to detect the pattern formed thereon, a displacement calculation mechanism configured to obtain a predetermined value and preset reference values, to calculate the amount of displacement based on the detected pattern and the preset reference values, and to determine whether or not the amount of the displacement is equal to or less than the predetermined value, and a displacement correction mechanism configured to correct the displacement based on the calculation.

The color image forming method includes the steps of obtaining a predetermined value and preset reference values, forming a pattern in a fine adjustment mode and, as necessary, a pattern in a rough adjustment mode on a transfer medium, detecting the pattern formed thereon in the fine and rough adjustment modes, calculating the amount of displacement based on the detected pattern and the preset reference values in the fine and rough adjustment modes, determining whether or not the amount of the displacement is equal to or less than the predetermined value in the fine adjustment mode, and correcting the displacement based on the calculation in the fine and rough adjustment modes.

This patent specification further describes a program for causing the color image forming apparatus to perform the color image forming method.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
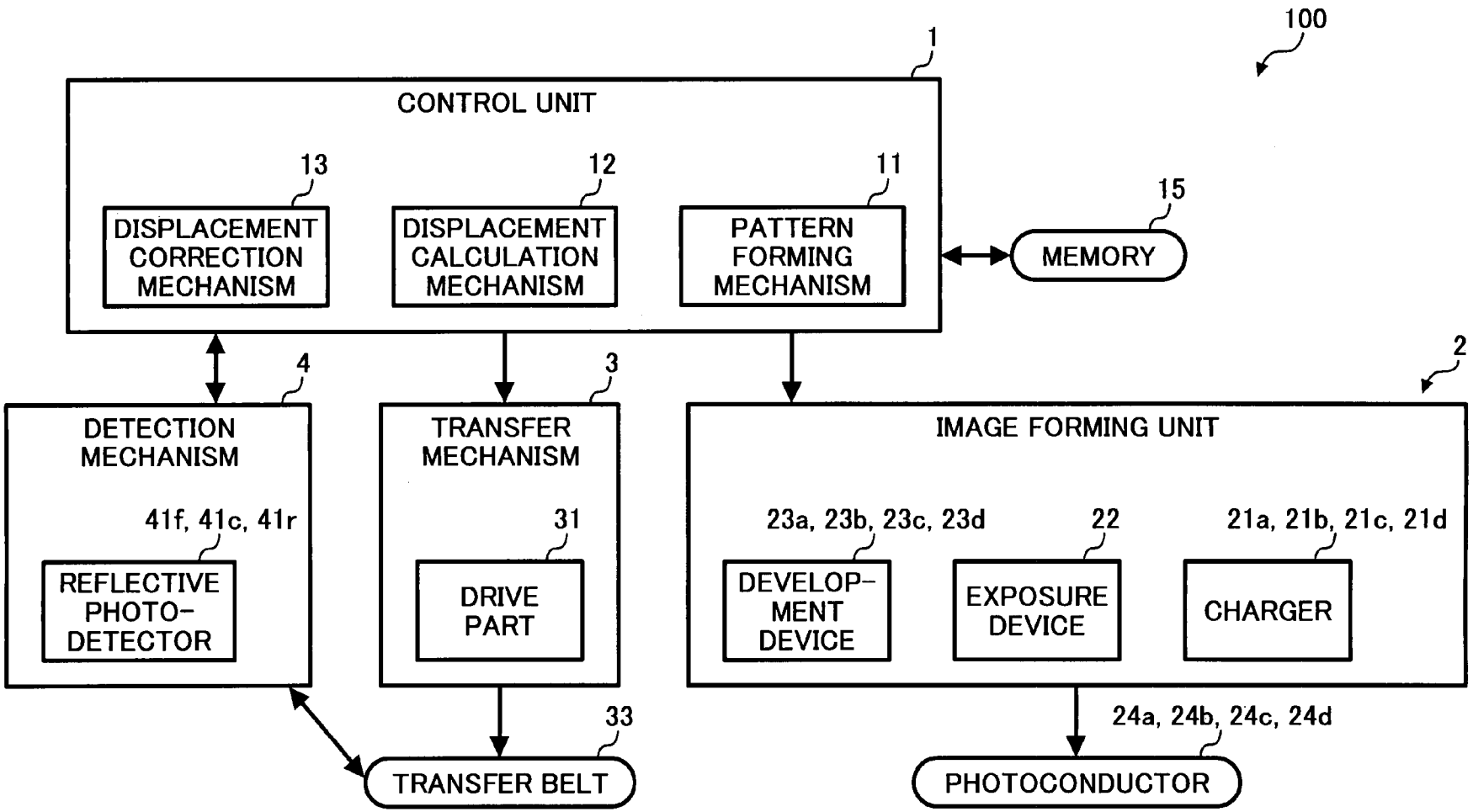
FIG. 1 is a functional block diagram of a color image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, a color image forming apparatus according to a preferred embodiment of the present invention is described.

FIG. 1 is a functional block diagram for explaining functions of a color image forming apparatus 100 according to the embodiment of the present invention.

As illustrated in FIG. 1, the color image forming apparatus 100 includes a control unit 1, an image forming unit 2, a transfer mechanism 3, a detection mechanism 4, a memory 15, and a transfer belt 33. The image forming unit 2 forms an image of a pattern used for measuring an amount of displacement of color registration. The transfer mechanism 3 rotates the transfer belt 33 so that the pattern for measurement is formed thereon. The detection mechanism 4 detects the pattern for measurement formed on the transfer belt 33. The control unit 1 controls entire processing of the image formation and the detection of the pattern, and calculates the amount of displacement and corrects the displacement.

The control unit 1 includes a pattern forming mechanism 11, a displacement calculation mechanism 12, and a displacement correction mechanism 13. The image forming unit 2 includes chargers 21*a*, 21*b*, 21*c*, and 21*d*, an exposure device 22, development devices 23*a*, 23*b*, 23*c*, and 23*d*, and photoconductors 24*a*, 24*b*, 24*c*, and 24*d*. The transfer mechanism 3 includes a drive part 31 for rotating the transfer belt 33 by using a roller. The detection mechanism 4 includes reflective photodetectors 41*f*, 41*c*, and 41*r*.

The memory 15 stores a predetermined value and preset reference values to be obtained and used by the displacement calculation mechanism 12. The memory 15 further stores pattern information including two types of patterns for measuring an amount of displacement of a toner image in each of four colors, black, cyan, magenta, and yellow being out of color registration. On measurement, the amount of displacement is measured based on the patterns stored therein. One of the two types of patterns is used for fine adjustment in a fine adjustment mode, and the other is used for rough adjustment in a rough adjustment mode.

Each of the patterns includes a set of marks corresponding to four colors, black, yellow, cyan, and magenta. The set of marks is formed at least 3 different locations, namely, the front, the center, and the rear in an axial direction of the photoconductors 24*a* to 24*d*. As a result, the pattern is transferred at the front, the center, and the rear in an axial direction of the transfer belt 33, in other words, at both sides and the center, on a surface of the transfer belt 33.

Figure 2:
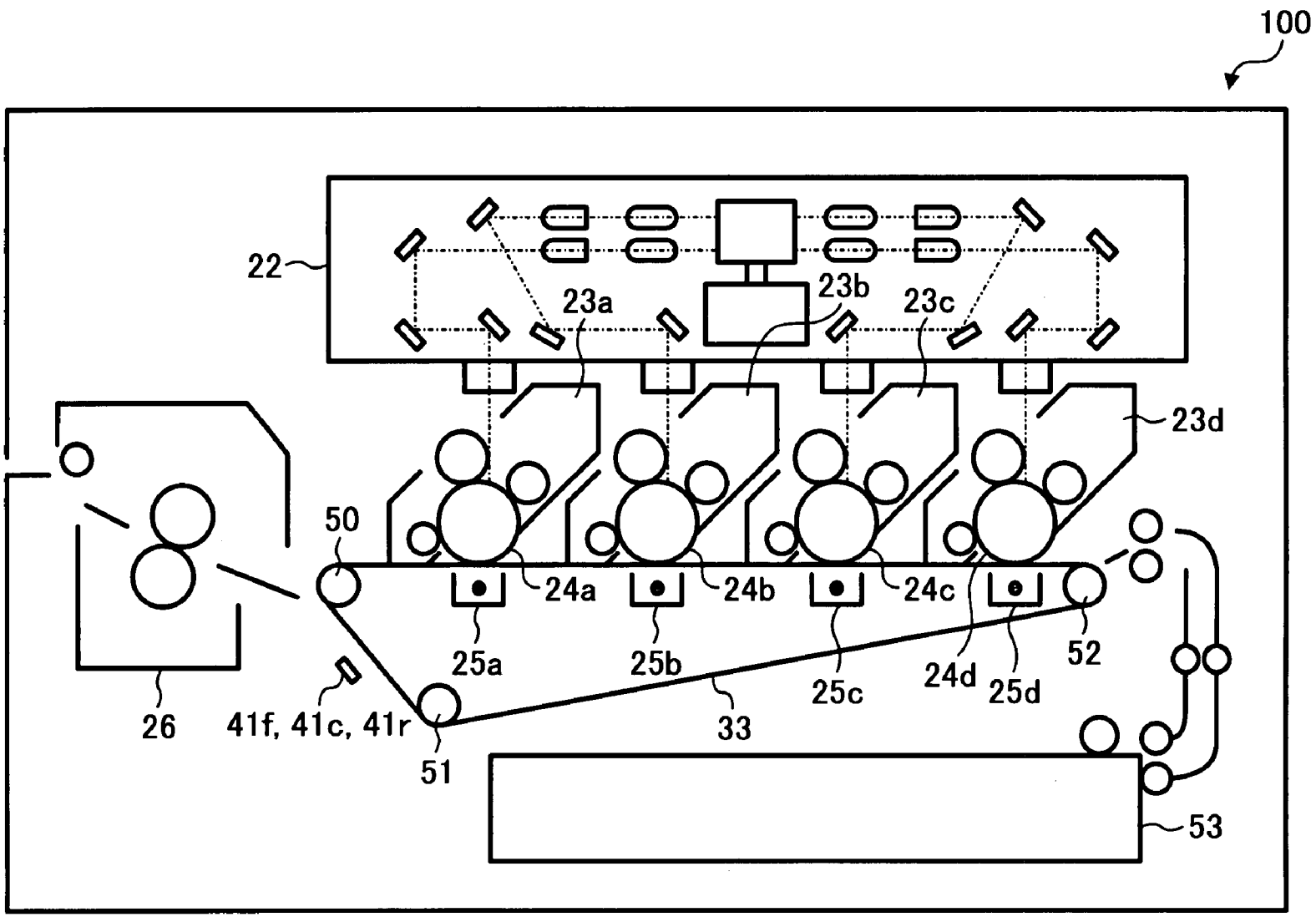
FIG. 2 is a schematic diagram illustrating an example configuration of the color image forming apparatus in FIG. 1.

FIG. 2 schematically illustrates an example configuration of the color image forming apparatus 100. As illustrated in FIG. 2, the color image forming apparatus 100 includes the chargers 21*a* to 21*d*, the exposure device 22, the development devices 23*a* to 23*d*, and the photoconductors 24*a* to 24*d* for black, magenta, cyan, and yellow (hereinafter referred to as K, M, C, and Y) included in the image forming unit 2 in FIG. 1. The color image forming apparatus 100 further includes transfer devices 25*a*, 25*b*, 25*c*, and 25*d*, a fixing device 26, a sheet feeding cassette 53, the transfer belt 33, and the reflective photodetectors 41*f*, 41*c*, and 41*r* included in the detection mechanism 4 in FIG. 1. The transfer belt 33 is a translucent endless belt, supported by a drive roller 50, a tension roller 51, and a driven roller 52 included in the drive part 31 of the transfer mechanism 3 in FIG. 1.

In general, when image data is input to the color image forming apparatus 100, the image data is converted to four-color-image data for black, yellow, cyan, and magenta, and is transmitted to the exposure device 22. The exposure device 22 irradiates the photoconductors 24*a* to 24*d* with a laser beam emitted by a laser diode serving as a light source. The exposure device 22 thus forms a latent image for each of the four colors on corresponding one of the photoconductors 24*a* to 24*d*, in other words, for example, a latent image for yellow is formed on a photoconductor for yellow. Then, each of the development devices 23*a* to 23*d* develops the corresponding latent image to form a toner image in the corresponding color on the corresponding one of the photoconductors 24*a* to 24*d*. Normally, a transfer sheet is conveyed from the sheet feeding cassette 53 to the transfer belt 33, and each of the toner images is transferred by corresponding one of the transfer devices 25*a* to 25*d* onto the transfer sheet on the transfer belt 33, and is sequentially superimposed to form a full color image thereon.

When the full color image is formed, however, various factors cause each of the colors to be out of color registration, in other wards, displaced from each other, resulting in lowered image quality. Therefore, to measure and correct the displacement, the embodiment is configured to form a full color image on the transfer belt 33.

Main functions of the color image forming apparatus 100 according to the embodiment of the present invention are briefly described below referring to FIGS. 1 and 2.

The pattern forming mechanism 11 reads the pattern for fine adjustment, and, as necessary, the pattern for rough adjustment each including the marks from the memory 15. Then, the pattern forming mechanism 11 controls the chargers 21*a* to 21*d*, the exposure device 22, and the photoconductors 24*a* to 24*d* to form an electrostatic latent image from each of the marks on each of the photoconductors 24*a* to 24*d*. Specifically, the electrostatic latent image is formed by exposing with the exposure device 22 each of the photoconductors 24*a* to 24*d* charged by each of the chargers 21*a* to 21*d*.

The pattern forming mechanism 11 further controls each of the development devices 23*a* to 23*d* to form a color image from the electrostatic latent image. The color image is transferred onto the transfer belt 33 to form a full color image of the pattern. As described above, the full color image of the pattern is formed at the front, the center, and the rear on the transfer belt 33.

In the detection mechanism 4, the reflective photodetectors 41*f*, 41*c*, and 41*r* arranged at the front, the center, and the rear, respectively, sense the patterns formed at the front, the center, and the rear, respectively, on the transfer belt 33, and detect positions of the marks in the pattern formed thereon.

The displacement calculation mechanism 12 calculates the amount of displacement of each of the color images based on the detected position of each of the marks and corresponding one of the preset reference values. The calculation is described in detail below. The displacement calculation mechanism 12 judges whether or not the calculated amount of displacement is within the scope of the fine adjustment.

The displacement correction mechanism 13 calculates an amount of shift for correcting the position of each of the color images according to the amount of displacement derived by the displacement calculation mechanism 12. The displacement correction mechanism 13 controls the image forming unit 2 to correct the displacement in a stage where a latent image for one of the four colors is formed on corresponding one of the photoconductors 24*a* to 24*d* by shifting a position where laser is shone by performing logic scanning both in a main scanning direction and in a sub-scanning direction so that the displacement can be corrected without adversely affecting positions of latent images for the other colors. The main scanning direction is a direction of laser scanning by using a polygon mirror or the like, and the sub-scanning direction is a direction of movement of the photoconductor.

Figure 3:
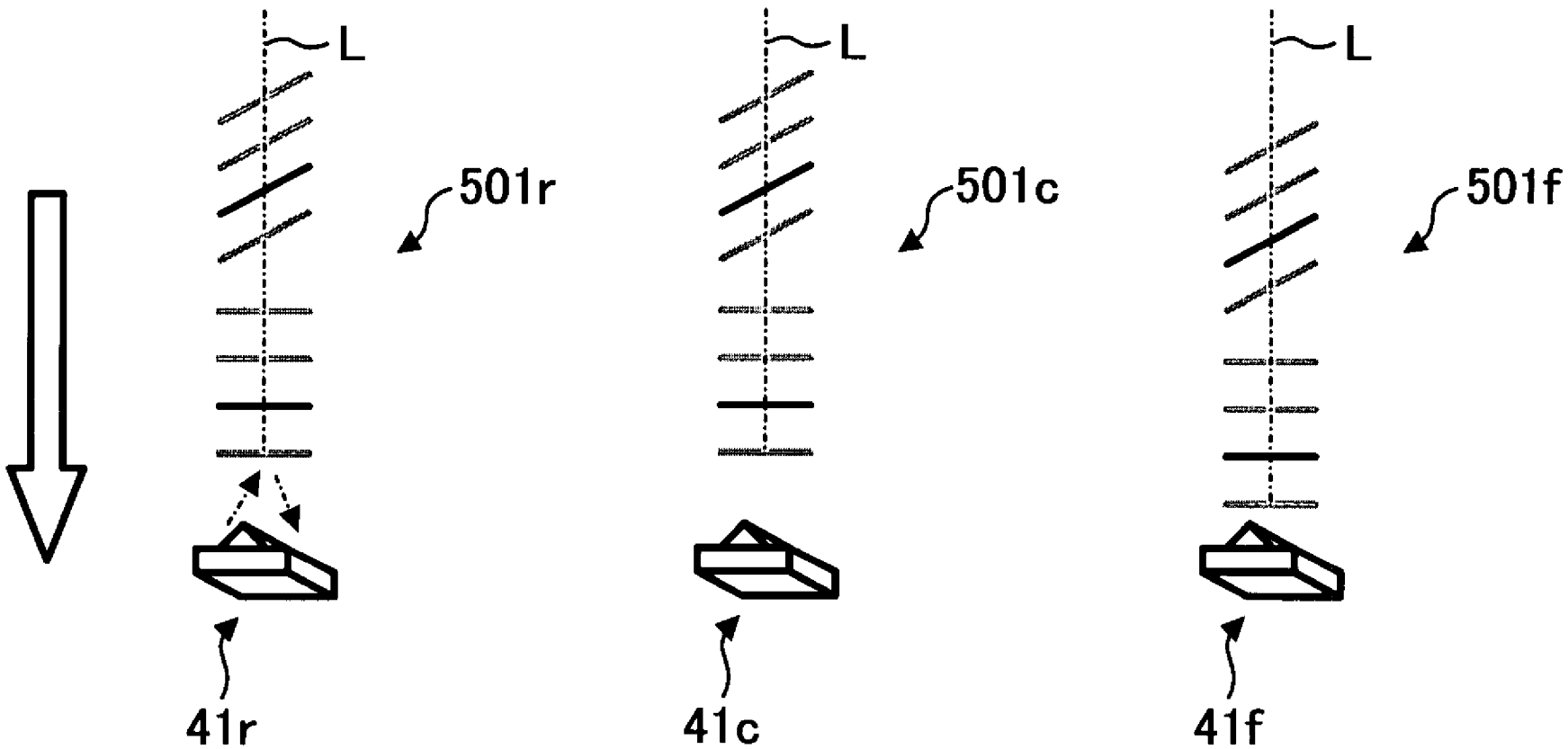
FIG. 3 is an illustration showing patterns for measurement and how the patterns are detected.

FIG. 3 is an illustration showing a front pattern 501*f*, a center pattern 501*c*, and a rear pattern 501*r* for measurement formed on the transfer belt 33 and how the patterns are detected. Specifically, each of the front pattern 501*f*, the center pattern 501*c*, and the rear pattern 501*r* includes at least a set of marks. The reflective photodetector 41*f*, the reflective photodetector 41*c*, and the reflective photodetector 41*r* read the pattern 501*f*, the pattern 501*c*, and the pattern 501*r*, respectively, to detect a position of each of the marks.

In FIG. 3, a center line L represents a center line of the patterns, and as the patterns move in a direction of an outlined arrow, detection is performed.

A configuration of the pattern for measurement may be such that a plurality of patterns for measurement are formed in the sub-scanning direction. Use of the plurality of patterns for measurement may enhance accuracy in the detection of displacement, and improve reliability. In the embodiment, however, a description of operation for improving the reliability by forming the plurality of patterns in the sub-scanning direction is omitted for the sake of simplification of descriptions.

Figure 4:
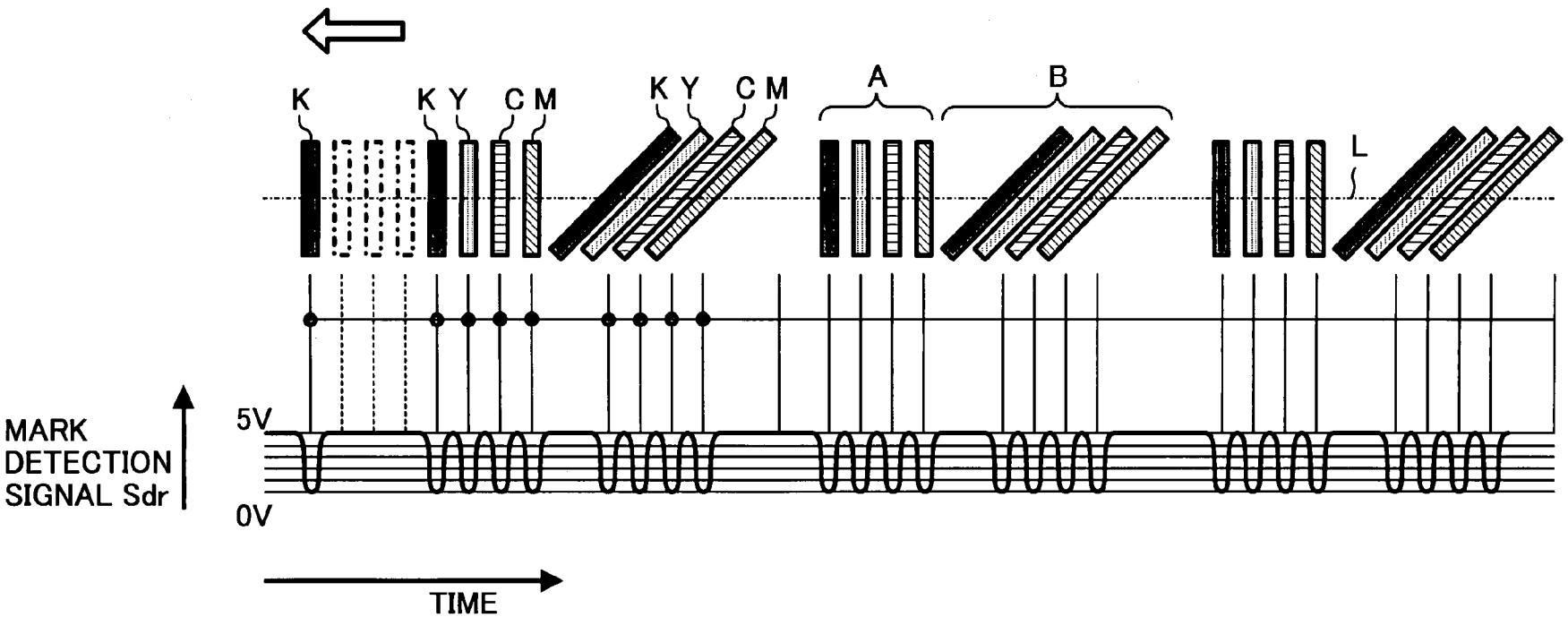
FIG. 4 is an illustration showing marks included in the pattern for measurement, and a relationship between a level of a mark detection signal and time.

FIG. 4 is an illustration showing the marks included in the pattern for measurement formed, for example, at the front on the transfer belt 33 by the pattern forming mechanism 11, and read by the reflective photodetector 41*f*. The description below also applies to the marks formed at the center and the rear on the transfer belt 33 and the reflective photodetectors 41*c* and 41*r*. Each of the reflective photodetectors 41*f*, 41*c*, and 41*r* includes a light emitting element, an integrator, an amplifier, and so forth (not shown), and receives reflected light from the transfer belt 33 or transmitted light through a slit (not shown) with a photoelectric transducer such as a phototransistor (not shown).

As illustrated in FIG. 4, a mark group A represents a parallel pattern including a M mark, a C mark, a Y mark, and a K mark each arranged in parallel to the main scanning direction, that is the width direction of the transfer belt 33. And a mark group B represents a tilt pattern including another M mark, another C mark, another Y mark, and another K mark arranged at an angle of, for example, 45 degrees against the main scanning direction.

FIG. 4 illustrates a relationship between a level of a mark detection signal Sdr and time, and the relationship is described below in detail referring to FIG. 5.

As illustrated in FIG. 4, the marks in strip shapes are formed with an interval between the marks. In the embodiment, the K mark is used as reference for forming the other marks with intervals. A distance between the K mark and each of the other marks is determined by a timing in which each of the other marks is formed on corresponding one of the photoconductors 24*a* to 24*d* by the exposure device 22 under the control of the pattern forming mechanism 11.

The timing in which each of the marks is formed differs between a mode in which the pattern for fine adjustment is used and another mode in which the pattern for rough adjustment is used. A sampling interval needs to be changed in each of the modes.

The K mark being the reference and the other marks read by the reflective photodetectors 41*f* are detected as described below.

When the phototransistor receives the light, impedance between a collector and an emitter becomes low, electric potential of the emitter, in other words, a level of the mark detection signal at the reflective photodetector 41*f* increases to, for example, 5 volts as illustrated in FIG. 4.

When the pattern for measurement comes into a position of the reflective photodetector 41*f*, as one of the marks blocks light, the impedance between the collector and the emitter becomes high. As a result, the electric potential of the emitter decreases. The level of the mark detection signal in such a case is, for example, 0 volts as illustrated in FIG. 4.

In other words, presence of each of the marks in the pattern for measurement is detected on the center line L, and the position of each of the marks is detected as the level of the mark detection signal fluctuates. The timing in which the position of each of the marks is precisely detected is described below referring to FIG. 5.

Figure 5:
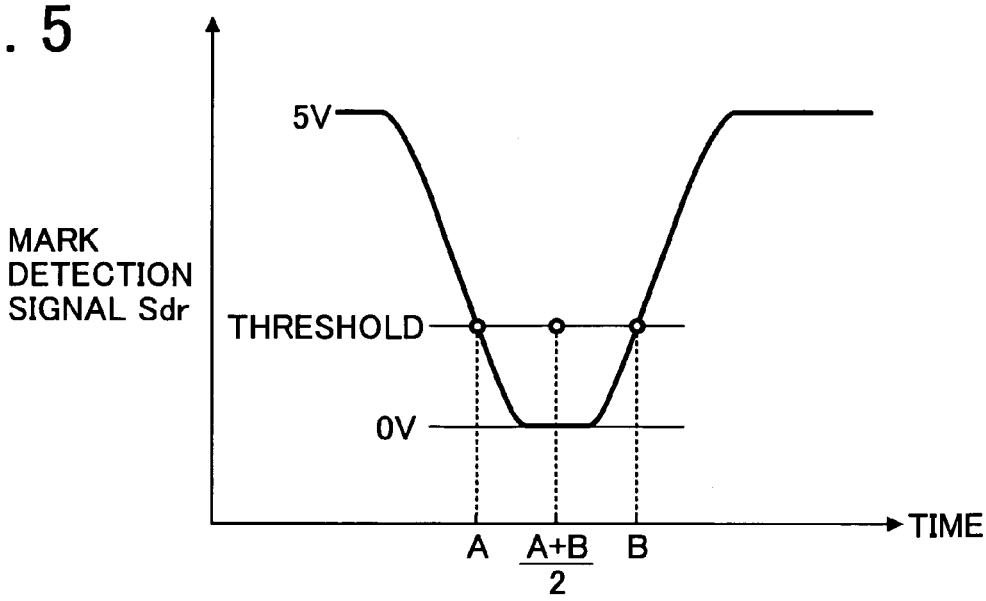
FIG. 5 is a graphical representation of the relationship between a level of a mark detection signal and time shown in FIG. 4.

FIG. 5 illustrates the relationship between the level of the mark detection signal Sdr and time. The mark detection signal Sdr is subjected to A/D (analog to digital) conversion with a predetermined pitch, and the converted signal is stored in the memory 15. Based on the stored signal, a scanning position is determined.

When the mark comes into the position of the reflective photodetector 41*f*, the level of the mark detection signal decreases, plotting a concave curve. Points in time when the level of the mark detection signal goes below and over a predetermined threshold may be detected. When A and B represent the points, a midpoint is expressed as (A+B)/2. The midpoint (A+B)/2 represents a point in time when a midpoint of the mark in the sub scanning direction comes into the position of the reflective photodetector 41*f*. The midpoint (A+B)/2 is derived as precisely representing when the position of the mark is detected.

Based on the position of the mark, a distance between the detected mark and the reference K mark is derived. By comparing the distance with the corresponding preset reference value stored in the memory 15, the displacement calculation mechanism 12 can derive the amount of displacement of the position of each of the mark in the pattern for measurement.

The displacement correction mechanism 13 controls the exposure device 22 to correct a position where an image is formed in the stage of exposure so as to offset the displacement of an image in each of the colors to be transferred onto the transfer belt. The correction is made by counting a clock frequency so as to offset the displacement caused by the shift in the timing of forming the image to correct operation in which the exposure device 22 forms the image in each of the photoconductors 24*a* to 24*d*.

A process of deriving the amount of displacement of each of the marks in the pattern for measurement in the sub-scanning direction is described below referring to FIGS. 6A through 8.

Figure 6A:
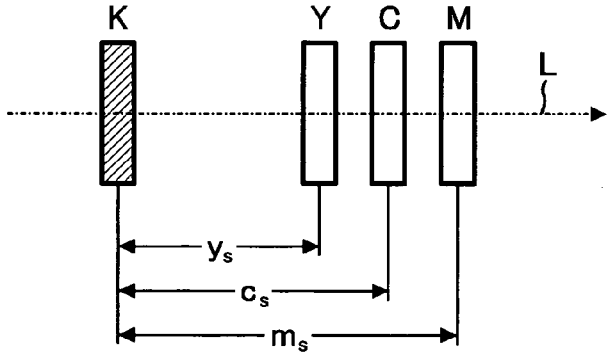
FIG. 6A is a schematic diagram illustrating an example of marks in a pattern for fine adjustment in a sub-scanning direction.
Figure 6B:
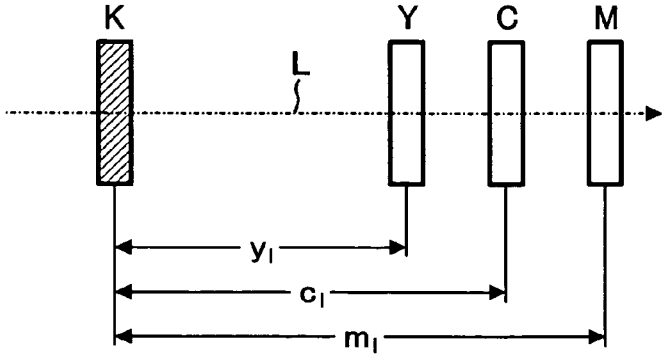
FIG. 6B is a schematic diagram illustrating an example of marks in a pattern for rough adjustment in the sub-scanning direction.

FIG. 6A is a schematic diagram illustrating an example of the marks in the pattern for measurement used for the fine adjustment in the sub-scanning direction. In FIG. 6A, distances ys, cs, and ms are distances between the K mark being the reference and the Y mark, the C mark, and the M mark, respectively, and represent the preset reference values to be used by the displacement calculation mechanism 12. FIG. 6B is a schematic diagram illustrating an example of the marks in the pattern for measurement used for the rough adjustment in the sub-scanning direction. In FIG. 6B, distances yl, cl, and ml are distances between the K mark being the reference and the Y mark, the C mark, and the M mark, respectively, and represent the preset reference values to be used by the displacement calculation mechanism 12.

Figure 7A:
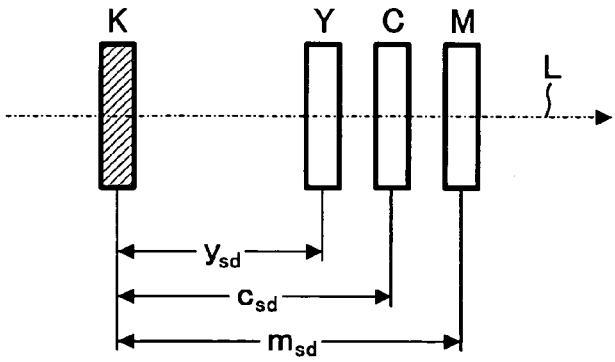
FIG. 7A is a schematic diagram illustrating detected marks in the pattern for the fine adjustment in the sub-scanning direction.
Figure 7B:
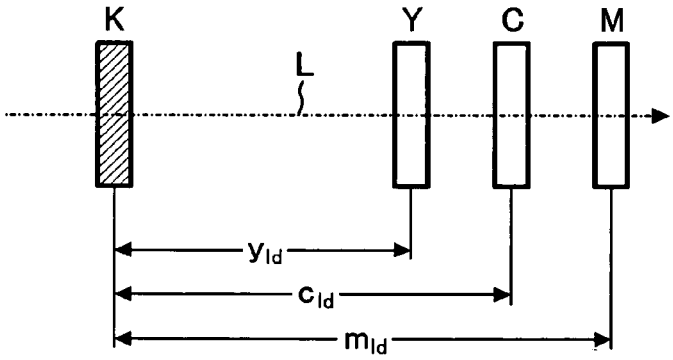
FIG. 7B is a schematic diagram illustrating detected marks in the pattern for the rough adjustment in the sub-scanning direction.

FIG. 7A is a schematic diagram illustrating the marks in the pattern for the fine adjustment detected by the reflective photodetector 41*f*. Distances ysd, csd, and msd represent distances between the K mark being the reference and the Y mark, the C mark, and the M mark, respectively, derived by the displacement calculation mechanism 12 based on the information on the position of each of the marks. FIG. 7B is a schematic diagram illustrating the marks in the pattern for the rough adjustment detected by the reflective photodetector 41*f*. Distances yld, cld, and mld represent distances between the K mark being the reference and the Y mark, the C mark, and the M mark, respectively, derived by the displacement calculation mechanism 12 based on the information on the position of each of the marks.

Figure 8:
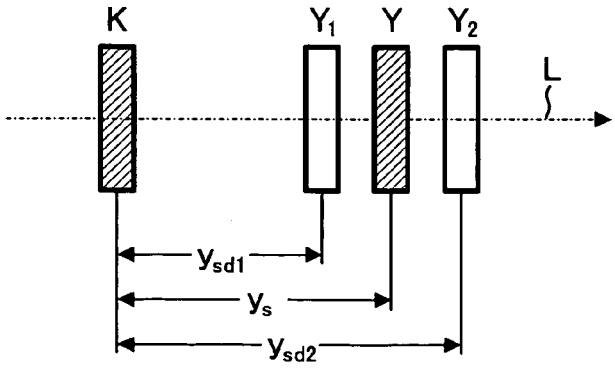
FIG. 8 is a schematic diagram for explaining detection of displacement in the sub-scanning direction by using the pattern for the fine adjustment in the sub-scanning direction.

FIG. 8 is a schematic diagram for explaining detection of displacement in the sub-scanning direction by using the pattern for measurement for the fine adjustment in the sub-scanning direction. The diagram illustrates only the K mark and the Y mark in the case of the fine adjustment to simplify the explanation. Description below applies to the C mark and the M mark, and to the rough adjustment. The detection of displacement in the sub-scanning direction is described below referring to FIGS. 6A to 8.

The pattern for measurement to control the fine adjustment are set as marks each in corresponding one of the colors having short intervals between the marks by causing the pattern forming mechanism 11 to count with a clock frequency having short intervals. Similarly, the pattern for measurement to control the rough adjustment are set as marks each in corresponding on of the colors having long intervals between the marks by causing the pattern forming mechanism 11 to count with a clock frequency having long intervals. The marks included in the pattern for the above two types of adjustment are the same but the intervals between the marks are different. As the interval between the marks becomes longer, a range to be covered by the measurement becomes wider, although accuracy decreases.

The reflective photodetector 41*f* reads the position of the mark in each of the colors in the sub-scanning direction formed on the transfer belt 33, wherein the position to be read is on the center line L in a direction of movement of the pattern for measurement. Position information can be measured by counting a clock number at the time when the mark comes into the position of reading. As illustrated in FIG. 3, in the embodiment, displacement is measured at the three locations, the both sides and the center in the main scanning direction on the transfer belt 33.

As illustrated in FIG. 8, in the case the adjustment for each of the colors in the sub-scanning direction is to be performed, displacement between the K mark and the Y mark in the sub-scanning direction is detected by comparing the distance ysd and the distance ys being the corresponding preset reference value. A distance ysd1 schematically illustrates that the distance between the reference mark K and the mark Y is shortened due to displacement, while a distance ysd2 schematically illustrates that the distance between the reference mark K and the mark Y is lengthened due to displacement. A relationship between the distances satisfies the following relational expression:

$$ysd1 < ys < ysd2.$$

As described above, the reflective photodetector 41*f* obtains the information on the position of each of the marks in the sub-scanning direction based on the reference mark K both in the fine adjustment mode and in the rough adjustment mode. The obtained information on the positions is transmitted to the displacement calculation mechanism 12, and the amount of the displacement in the sub-scanning direction is calculated therein.

Next, a process of deriving the amount of displacement of each of the marks in the pattern for measurement in the main scanning direction is described below referring to FIG. 9A through FIG. 11

Figure 9A:
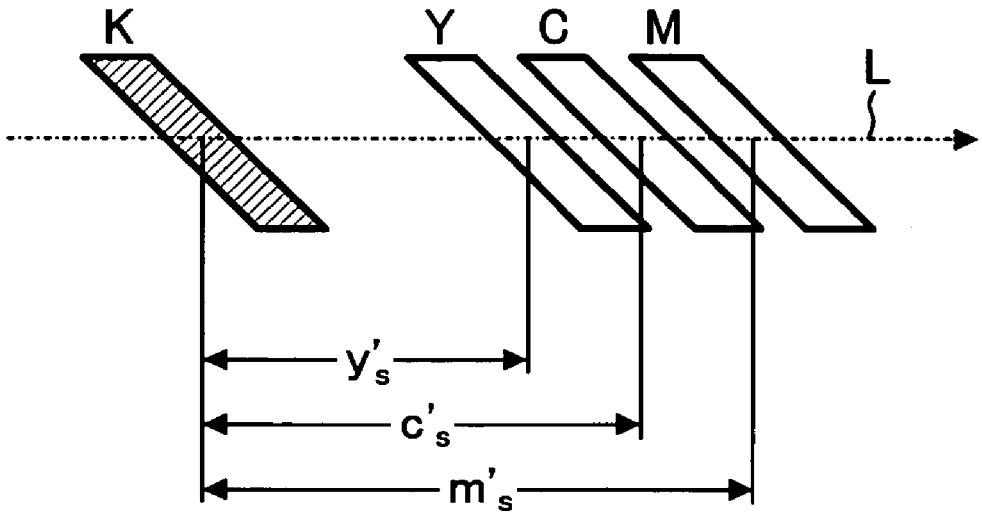
FIG. 9A is a schematic diagram illustrating an example of marks in a pattern for fine adjustment in a main scanning direction.
Figure 9B:
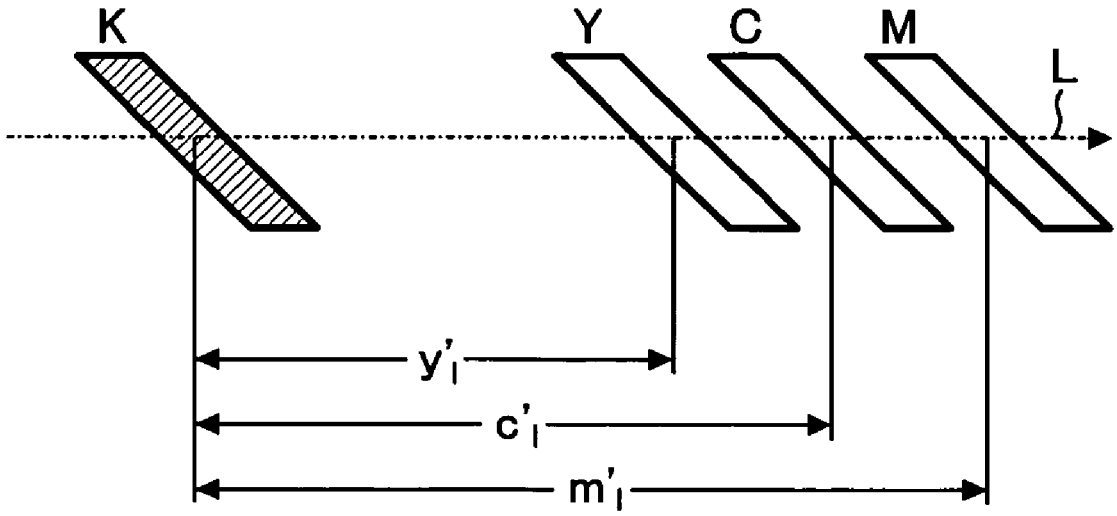
FIG. 9B is a schematic diagram illustrating an example of marks in a pattern for rough adjustment in the main scanning direction.

FIG. 9A is a schematic diagram illustrating an example of the marks in the pattern for measurement used for the fine adjustment in the main scanning direction. In FIG. 9A, distances y's, c's, and m's are distances between the K mark being the reference and the Y mark, the C mark, and the M mark, respectively, and represent the preset reference values to be used by the displacement calculation mechanism 12. FIG. 9B is a schematic diagram illustrating an example of the marks in the pattern for measurement used for the rough adjustment in the main scanning direction. In FIG. 9B, distances y'l, c'l, and m'l are distances between the K mark being the reference and the Y mark, the C mark, and the M mark, respectively, and represent the preset reference values to be used by the displacement calculation mechanism 12.

Figure 10A:
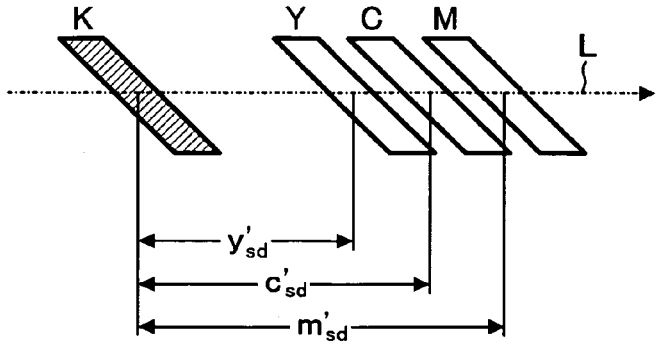
FIG. 10A is a schematic diagram illustrating detected marks in the pattern for the fine adjustment in the main scanning direction.
Figure 10B:
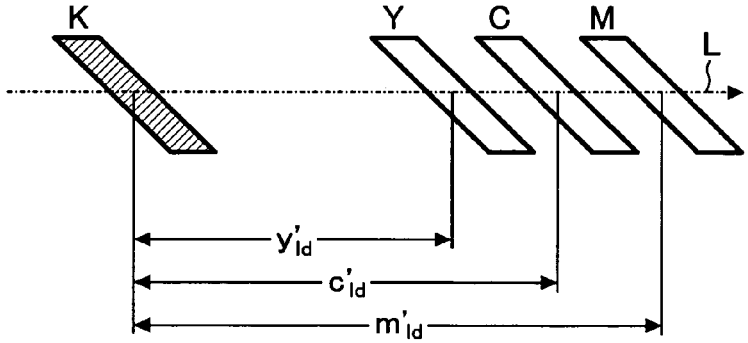
FIG. 10B is a schematic diagram illustrating detected marks in the pattern for the rough adjustment in the main scanning direction.

FIG. 10A is a schematic diagram illustrating the marks in the pattern for the fine adjustment detected by the reflective photodetector 41*f*. Distances y'sd, c'sd, and m'sd represent distances between the K mark being the reference and the Y mark, the C mark, and the M mark, respectively, derived by the displacement calculation mechanism 12 based on the information on the position of each of the marks. FIG. 10B is a schematic diagram illustrating the marks in the pattern for the rough adjustment detected by the reflective photodetector 41*f*. Distances y'ld, c'ld, and m'ld represent distances between the K mark being the reference and the Y mark, the C mark, and the M mark, respectively, derived by the displacement calculation mechanism 12 based on the information on the position of each of the marks.

Figure 11:
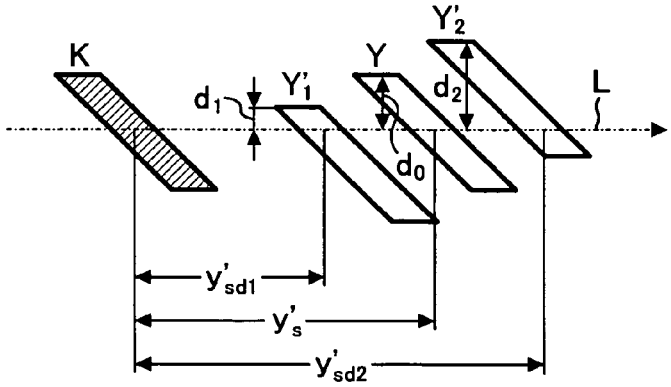
FIG. 11 is a schematic diagram for explaining detection of displacement in the main scanning direction by using the pattern for the fine adjustment in the main scanning direction.

FIG. 11 is a schematic diagram for explaining detection of displacement in the main scanning direction by using the pattern for measurement for the fine adjustment in the main scanning direction. The diagram illustrates only the K mark and the Y mark in the case of the fine adjustment to simplify the explanation. Description below applies to the C mark and the M mark, and to the rough adjustment. The detection of displacement in the main scanning direction is described below referring to FIGS. 9A to 11.

When the displacement in the main direction is represented as a value of distance in the sub-scanning direction, the distance representing a reference position of the Y mark based on the reference K mark is a distance y's. When the Y mark is formed in the position with shortened distance from the K mark, the distance representing the position of the Y mark is represented by a distance y'sd1. When the Y mark is formed in the position with lengthened distance from the K mark, the distance representing the position of the Y mark is represented by a distance y'sd2. The distances y'sd1 and y'sd2 being the distances in the sub-scanning direction are derived according to distances d1 and d2 representing the displacement in the main scanning direction, respectively. Values used as the reference are the distance ys' in the case of the measurement in the sub-scanning direction, and a distance d0 in the case of the measurement in the main scanning direction.

When actual measurement is performed, although displacement in the main scanning direction is detected as displacement in the sub-scanning direction, the amount of displacement in the main scanning direction represented as the displacement in the sub-scanning direction includes the displacement originally caused in the sub-scanning direction. Therefore, the displacement originally caused in the sub-scanning direction needs to be corrected. However, a description of the correction is omitted in the embodiment for the sake of simplicity of description.

As described above, the reflective photodetector 41*f* may obtain information on the position of each of the marks based on the reference K mark in the main scanning direction both in the fine adjustment mode and in the rough adjustment mode. The obtained information on the positions is transmitted to the displacement calculation mechanism 12, and the amount of the displacement in the main scanning direction is calculated therein.

Next, a flow of an example procedure in which the color image forming apparatus 100 according to the embodiment of the present invention addresses displacement is described below.

Figure 12:
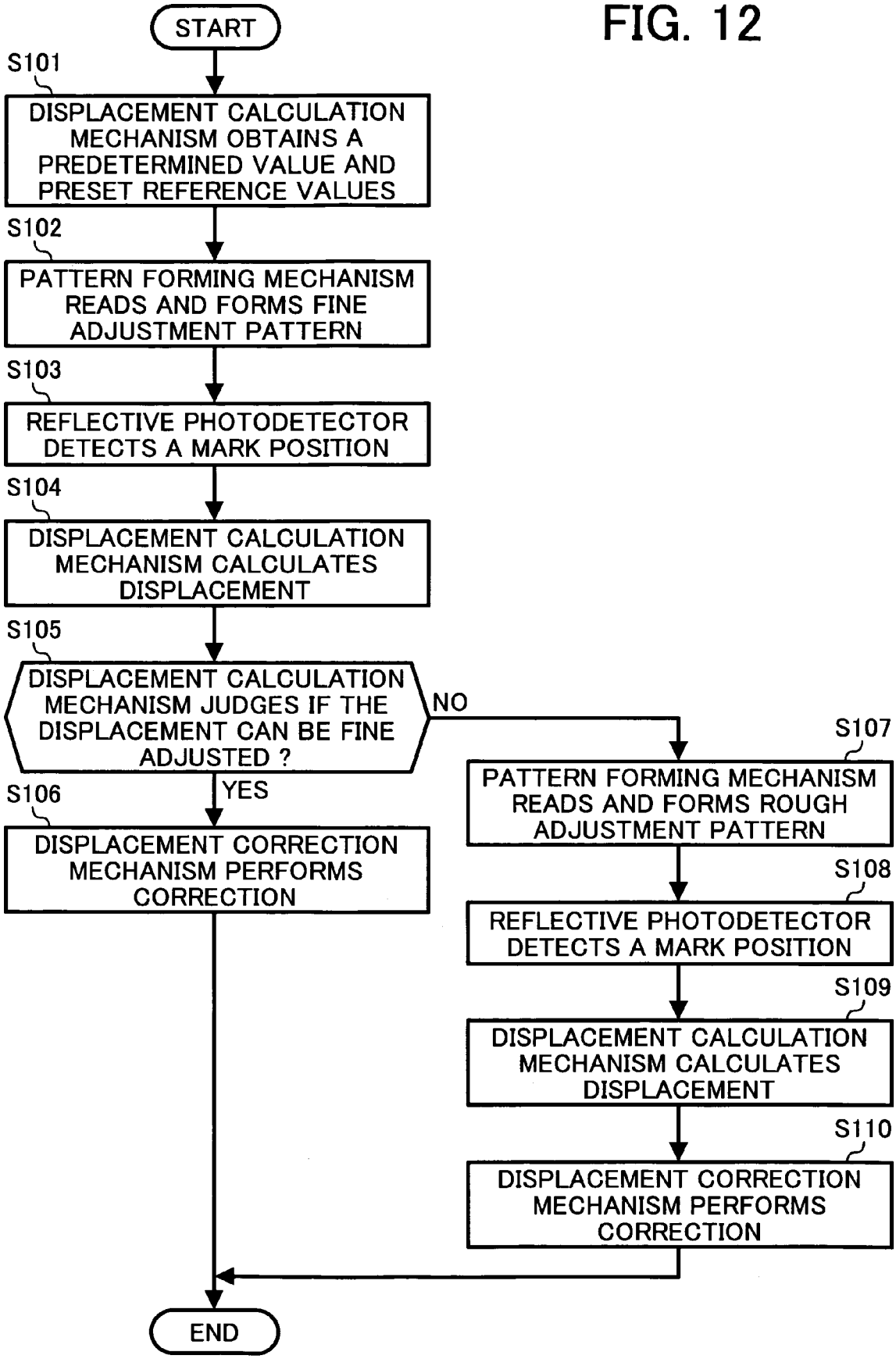
FIG. 12 is a flowchart for explaining an example procedure of addressing displacement.

FIG. 12 is a flowchart for explaining the procedure of addressing displacement. When the color image forming apparatus 100 is turned on, adjustment operation is automatically started. Alternatively, when adjustment of displacement is requested, the color image forming apparatus 100 receives an input for the adjustment operation. The displacement calculation mechanism 12 obtains the predetermined value and the preset reference values (step S101). The pattern forming mechanism 11 reads pattern information for fine adjustment from the memory 15, and the image forming unit 2 forms the pattern for fine adjustment on the transfer belt 33 (step S102).

As the pattern for fine adjustment formed on the transfer belt 33 moves forward driven by the transfer mechanism 3, the reflective photodetectors 41*r*, 41*c*, and 41*f* detect information on a position of the mark in each of the colors (step S103). The detected information on the position is transmitted to the displacement calculation mechanism 12, and an amount of displacement is calculated therein. In the displacement calculation mechanism 12, errors at the both sides and the center of the transfer belt 33 are derived as absolute values, and the derived absolute values of the errors are summed up to be the amount of displacement to be used for a judgment.

The displacement calculation mechanism 12 compares the derived amount of displacement with the predetermined value for the fine adjustment mode, and judges whether or not the amount of displacement occurred in the apparatus is within a scope of the fine adjustment. When the amount of displacement is so large as to go beyond the scope of the fine adjustment, and is judged as being out of the scope of the fine adjustment (step S105).

When the amount of displacement is judged as being within the scope of the fine adjustment ("Yes" in step S106), the displacement correction mechanism 13 calculates the amount of a shift for correction based on the derived absolute amount of displacement. When the image forming unit 2 forms an image, the derived amount of the shift for correction is taken into account in image forming processing (step S106).

When the displacement calculation mechanism 12 judges that the amount of displacement is so large as to go beyond the predetermined value for the fine adjustment mode, and is judged as being out of the scope of the fine adjustment ("No" in step S105), the pattern forming mechanism 11 reads the pattern for rough adjustment from the memory 15. The image forming unit 2 forms the pattern for rough adjustment on the transfer belt 33 (step S107).

As the marks in the pattern for rough adjustment formed on the transfer belt 33 moves forwards driven by the transfer mechanism 3, the reflective photodetectors 41*r*, 41*c*, and 41*f* detect information on a position of the mark in each of the colors (step S108). The detected information on the position is transmitted to the displacement calculation mechanism 12, and an amount of displacement is calculated therein (step S109). The displacement correction mechanism 13 derives the amount of a shift for correction from the calculated amount of displacement, and controls the image forming unit 2 to perform correction processing (step S110).

When the color image forming apparatus 100 is in normal operation, it is assumed that the amount of displacement is within the scope of the fine adjustment. Therefore, the color image forming apparatus 100 firstly measures the amount of displacement in the fine adjustment mode. In a normal case, only the fine adjustment is performed. Only when the amount of displacement is out of the scope of the fine adjustment, the rough adjustment is performed. After the correction in the rough adjustment mode is performed, the entire correction operation is finished. As described above, both adjustment having high accuracy and adjustment covering a wide scope may be performed, and as a result, a correction with high accuracy may be made in a wide range. Further, an image in which displacement has been corrected may be efficiently formed in a simple method. In particular, as a correction operation is firstly executed in the fine adjustment mode that is generally required during normal operation, consumption of excessive time and electricity may be avoided.

Figure 13:
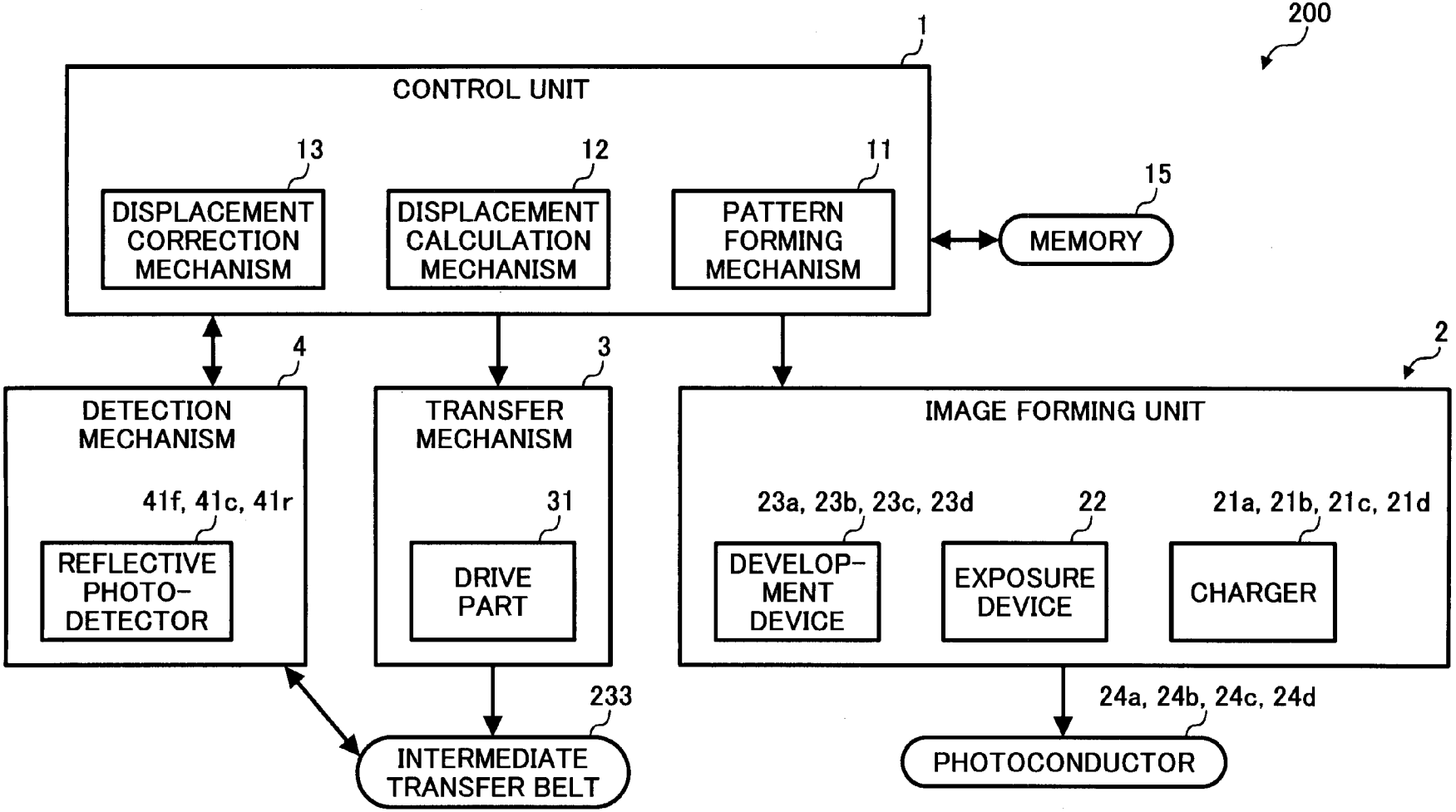
FIG. 13 is a functional block diagram of a color image forming apparatus according to another embodiment of the present invention.

A color image forming apparatus according to another embodiment of the present invention is described below. FIG. 13 is a functional block diagram for explaining functions of a color image forming apparatus 200 according to the embodiment. As illustrated in FIG. 13, the color image forming apparatus 200 includes the same functional components as the functional components of the color image forming apparatus 100 except that the color image forming apparatus 200 has an intermediate transfer belt 233 instead of the transfer belt 33.

Figure 14:
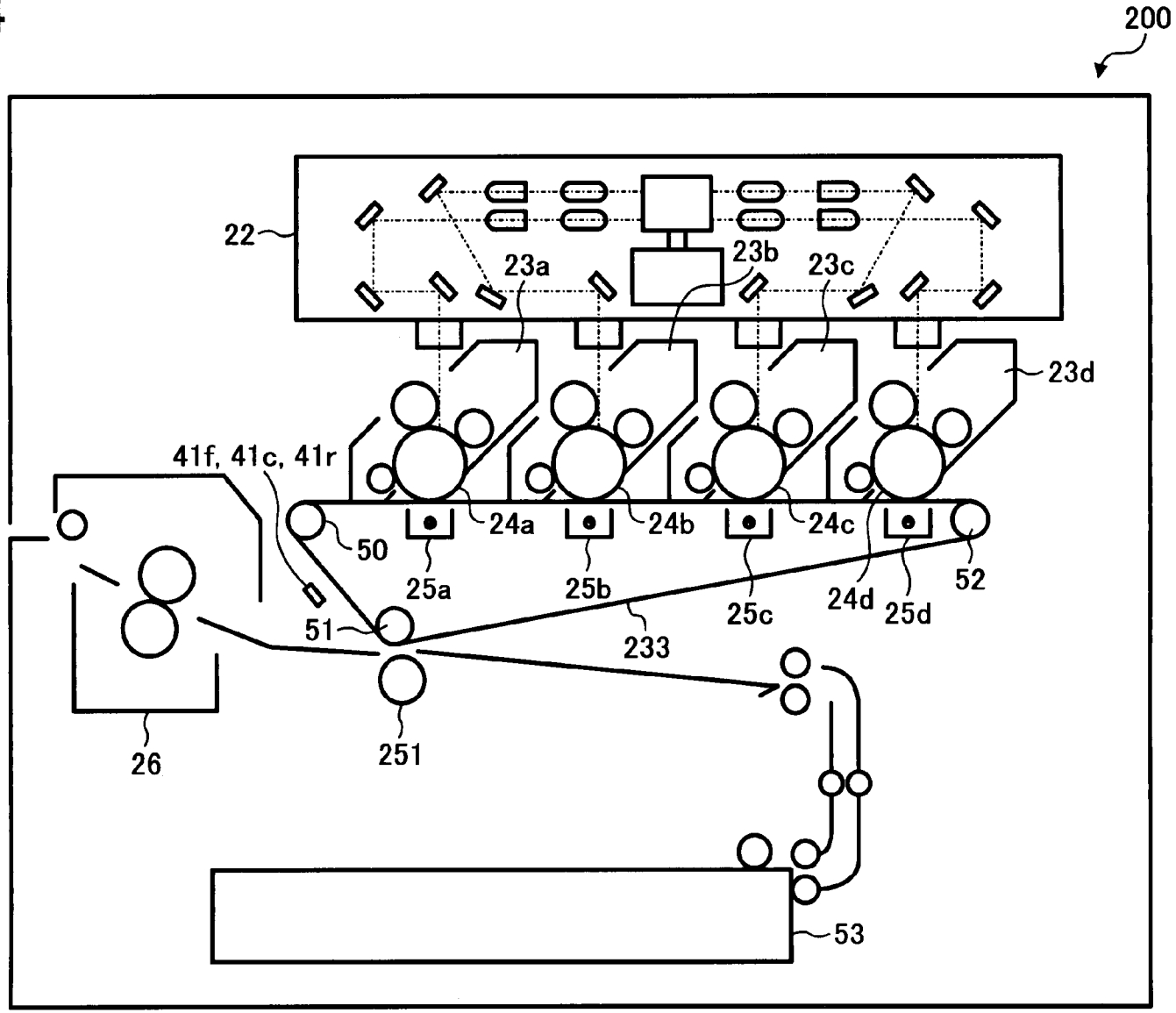
FIG. 14 is a schematic diagram illustrating an example configuration of the color image forming apparatus in FIG. 13.

FIG. 14 schematically illustrates an example configuration of the color image forming apparatus 200. As illustrated in the example shown in FIG. 14, the color image forming apparatus 200 has the same configuration as the configuration of the color image forming apparatus 100 except that the color image forming apparatus 200 includes the intermediated transfer belt 33 instead of the transfer belt 33, and accordingly has a transfer roller 251.

The functions of the color image forming apparatus 200 differ from the functions of the color image forming apparatus 100 in that the pattern for measurement is formed on the intermediated transfer belt 233, and the reflective photodetectors 41*f*, 41*c*, and 41*r* detect the pattern for measurement formed on the intermediated transfer belt 233.

Description of formation and detection of the pattern, calculation and correction of displacement is omitted as the description is the same as the description of the color image forming apparatus 100.

Figure 15:
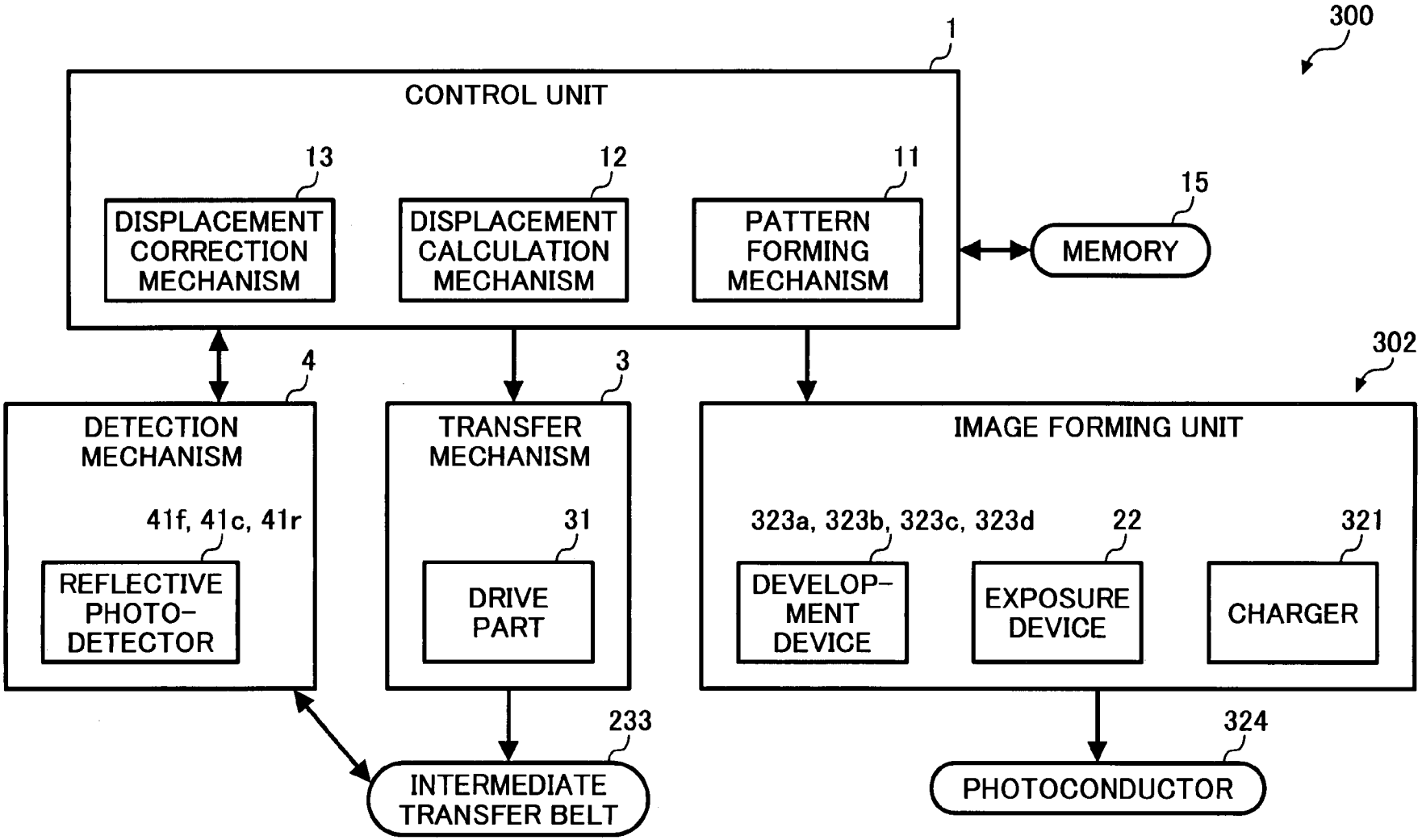
FIG. 15 is a functional block diagram of a color image forming apparatus according to another embodiment of the present invention.

A color image forming apparatus according to another embodiment of the present invention is described below. FIG. 15 is a functional block diagram for explaining functions of a color image forming apparatus 300 according to the embodiment. As illustrated in FIG. 15, the color image forming apparatus 300 includes the same functional components as the functional components of the color image forming apparatus 200 except that the color image forming apparatus 300 includes a single photoconductor 324, and accordingly, an image forming unit 302 is of a single-drum type.

Figure 16:
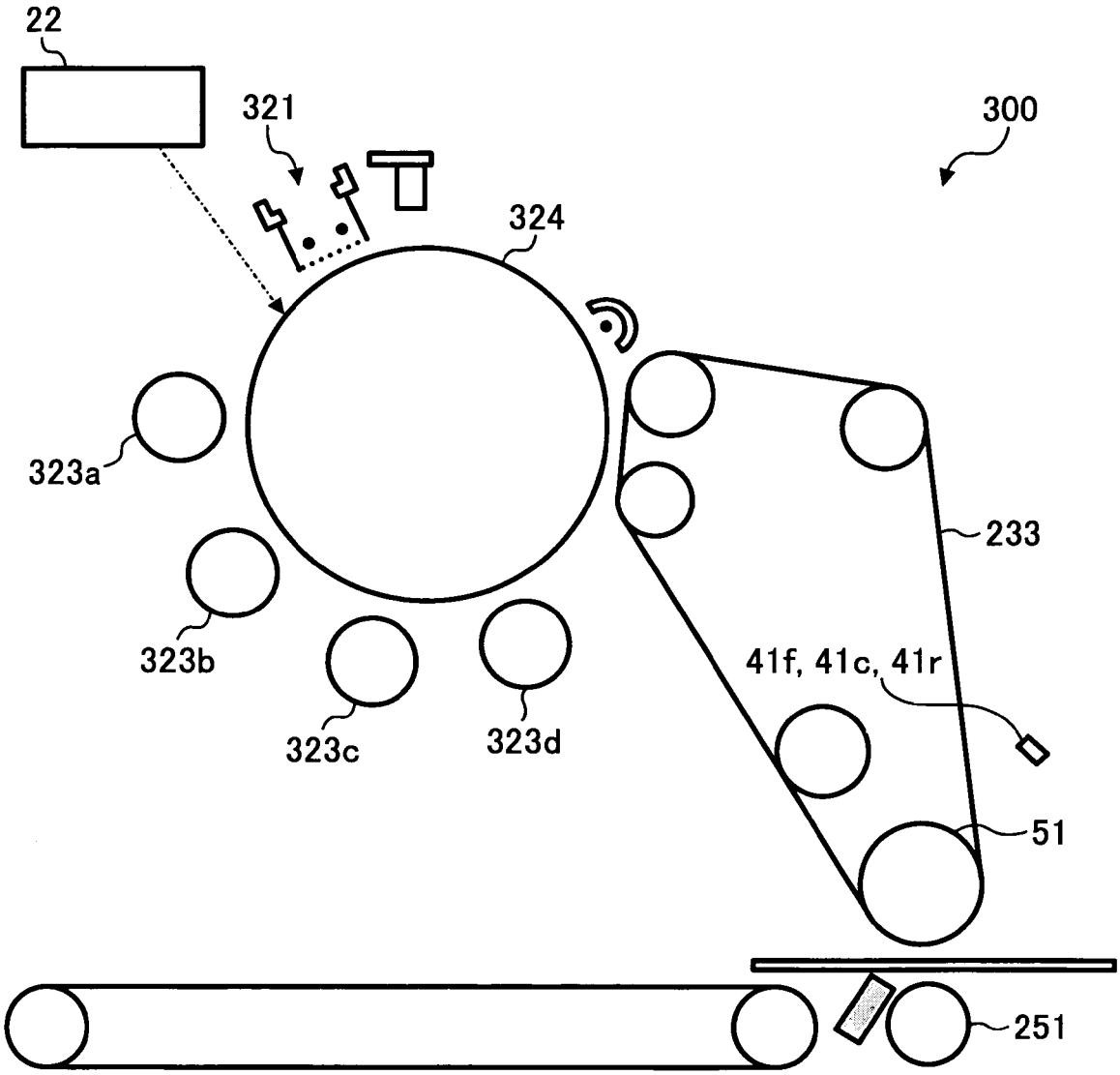
FIG. 16 is a schematic diagram illustrating an example configuration of the color image forming apparatus in FIG. 15.

FIG. 16 schematically illustrates an example configuration of the color image forming apparatus 300. Although a configuration of the color image forming apparatus 300 differs from the configuration of the color image forming apparatus 200 due to a difference in image forming methods, the pattern for measurement is formed on the intermediated transfer belt 233, and the reflective photodetectors 41*f*, 41*c*, and 41*r* detect the pattern for measurement formed on the intermediated transfer belt 233 as in the color image forming apparatus 200.

Description of formation and detection of the pattern, calculation and correction of displacement is omitted as the description is the same as the description of the color image forming apparatus 200.

Another embodiment of the present invention is described below. In the embodiment, the color image forming apparatus 100' has the same functional components as the functional components of the color image forming apparatus 100. Further, the color image forming apparatus 100' has the same configuration as the configuration of the color image forming apparatus 100.

Figure 17:
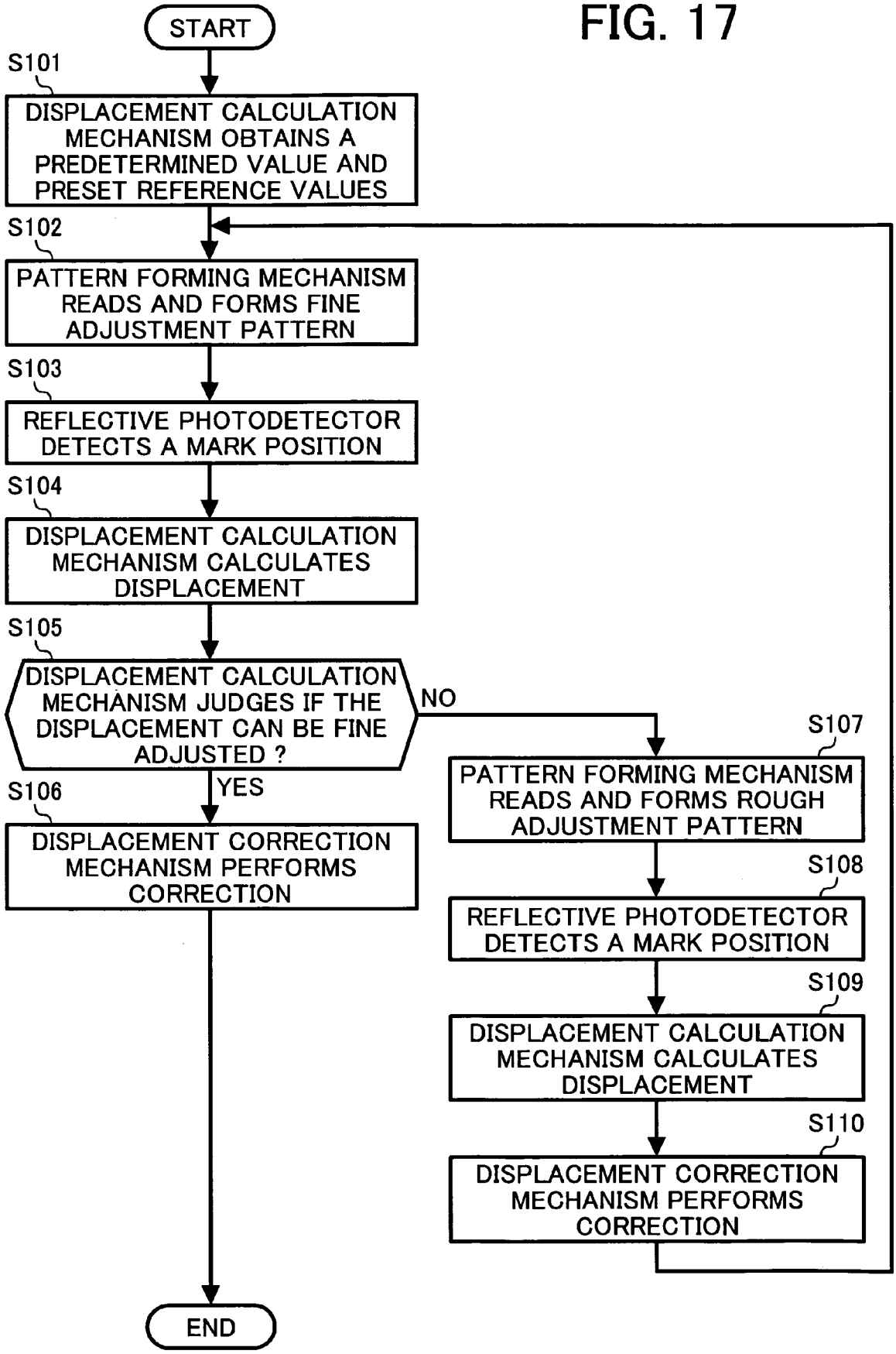
FIG. 17 is a flowchart for explaining another procedure of addressing displacement in another embodiment.

A difference between the embodiment and the embodiment in which the color image forming apparatus 100 is used is described below referring to FIG. 17. FIG. 17 is a flowchart for explaining another procedure of addressing displacement in the embodiment. Since the steps S101 to S110 are the same as the steps S101 to S110 in the procedure of the color image forming apparatus 100 in FIG. 12, description thereof is omitted. A difference between the flows of the procedures of the color image forming apparatus 100 and the color image forming apparatus 100' is explained by an arrow between S110 and S102. As shown in FIG. 17, after step S110 is finished, the color image forming apparatus 100' returns to step S102, and repeats the steps thereafter. In other words, when the result of the detection of the pattern for measurement is out of the scope of the fine adjustment (No in step S105), a correction is made in the rough adjustment mode (step S107 and thereafter), and then another correction is made in the fine adjustment mode (step S102 and thereafter) before finishing correction processing.

It is preferable that the flow of the procedure includes an error processing step in which a judgment is made to go to an end in case of an error to prevent the flow from falling into an infinite loop.

As described above, the amount of displacement is firstly measured in the fine adjustment mode that is generally required as the amount of displacement is normally small. Based on the result of the measurement, the fine adjustment and the rough adjustment are selectively performed. In a normal case, only the fine adjustment is performed. Only when the amount of displacement is out of the scope of the fine adjustment, the rough adjustment is performed and then the fine adjustment is performed. Therefore, an image in which displacement has been precisely corrected may be efficiently formed in a simple method.

Figure 18:
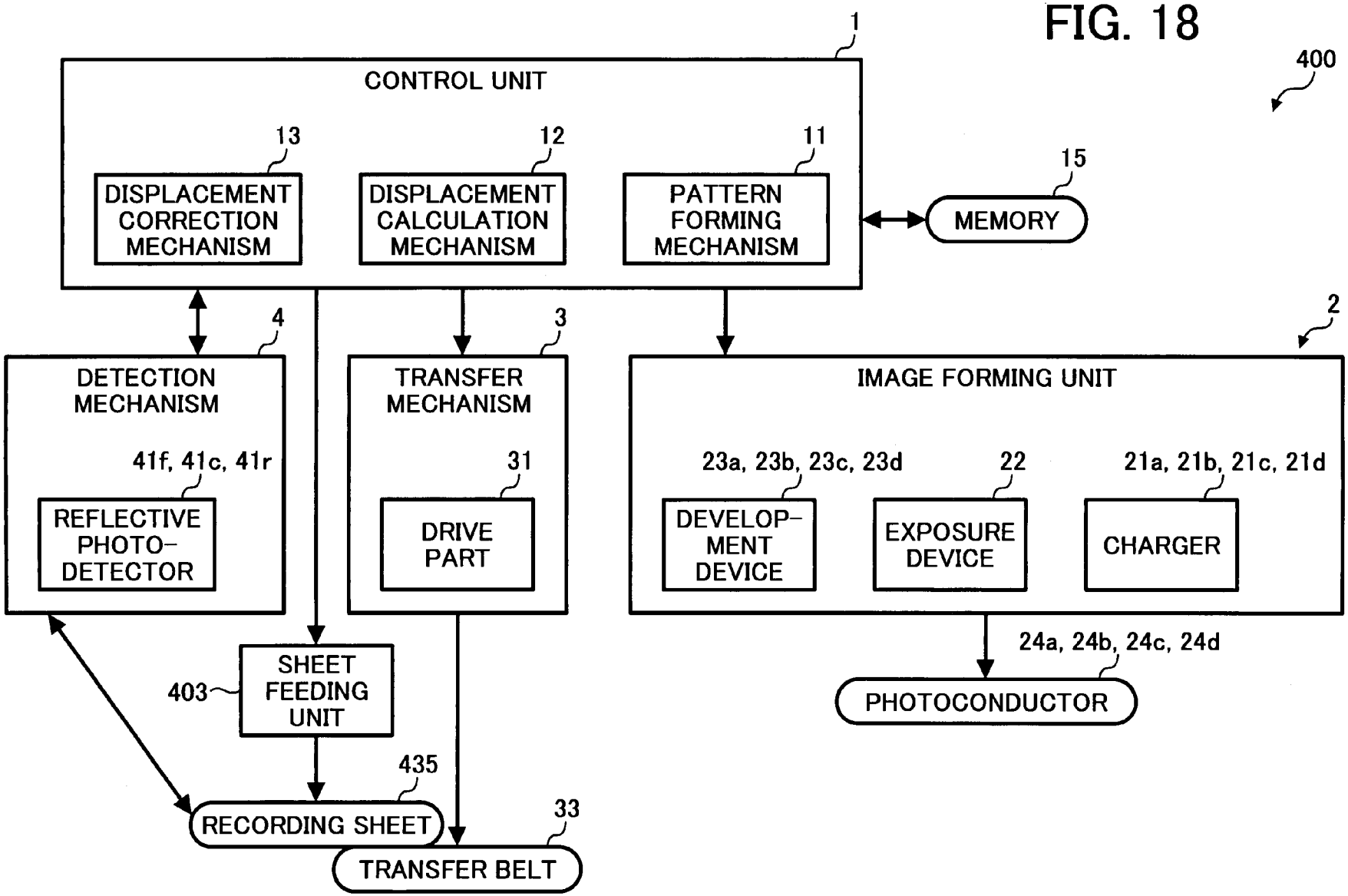
FIG. 18 is a functional block diagram of a color image forming apparatus according to another embodiment of the present invention.

A color image forming apparatus according to another embodiment of the present invention is described below. FIG. 18 is a functional block diagram for explaining functions of a color image forming apparatus 400 according to the embodiment. As illustrated in FIG. 18, the color image forming apparatus 400 includes the same functional components as the functional components of the color image forming apparatus 100 except that the color image forming apparatus 400 further includes a sheet feeding unit 403. A method of addressing displacement in the color image forming apparatus 400 differs from the method in the color image forming apparatus 100 in that the pattern for measurement is formed on a recording sheet 435, and the reflective photodetectors 41*f*, 41*c*, and 41*r* detect the pattern for measurement formed on the recording sheet 435.

Description of formation and detection of the pattern, calculation and correction of displacement is omitted as the description is the same as the description of the color image forming apparatus 100.

As the amount of displacement is calculated based on the pattern for measurement formed on the actual recording sheet 435, and the displacement is corrected based thereon, an image in which displacement has been accurately corrected may be efficiently formed in a simple method.

Figure 19:
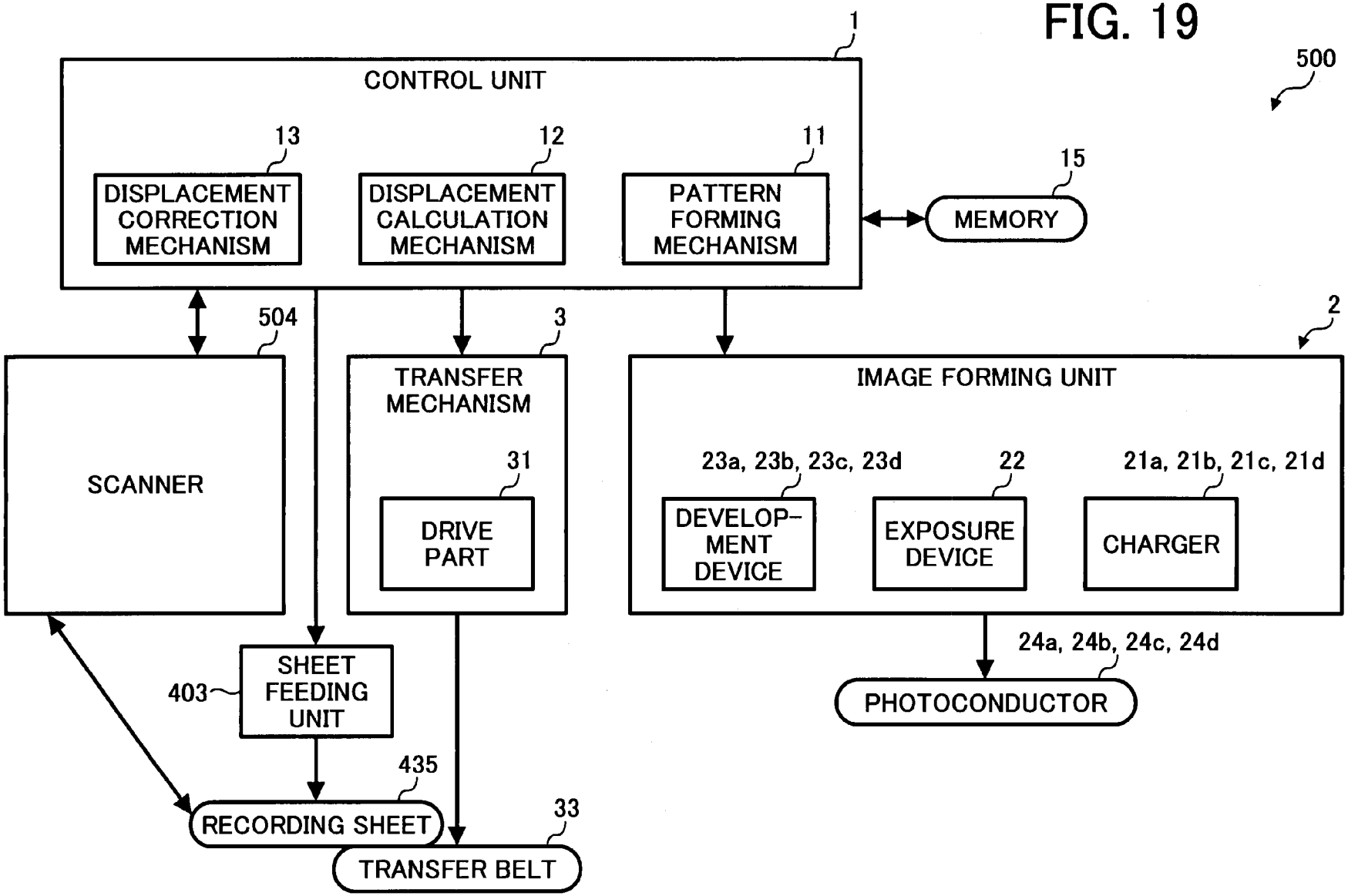
FIG. 19 is a functional block diagram of a color image forming apparatus according to another embodiment of the present invention.

A color image forming apparatus according to another embodiment of the present invention is described below. FIG. 19 is a functional block diagram for explaining functions of a color image forming apparatus 500 according to the embodiment. As illustrated in FIG. 19, the color image forming apparatus 400 includes the same functional components as the functional components of the color image forming apparatus 400 except that the color image forming apparatus 200 has a scanner 504 instead of the detection mechanism 4.

The color image forming apparatus 500 differs from the color image forming apparatus 400 in that the pattern for measurement formed on the recording sheet 435 is read by the scanner 504. The calculation of the amount of displacement is performed based on a result of the reading performed by the scanner 504.

Description of formation and of the pattern, calculation and correction of displacement is omitted as the description is the same as the description of the color image forming apparatus 400.

As the amount of displacement is read by the scanner 504 from the pattern for measurement formed on the accrual recording sheet 435, and the displacement is corrected based thereon, an image in which displacement has been accurately corrected may be efficiently formed in a simple method.

A color image forming apparatus according to another embodiment of the present invention is described below referring to FIGS. 20 to 24. The embodiment defers from the embodiment in which the color image forming apparatus 100 is used in that fluctuations in scanning magnification are corrected before the pattern for measurement is formed.

The fluctuations in scanning magnification refer to a phenomenon in which a main scanning width of light reflected from a polygon is fluctuated due to fluctuations in reflective index of a lens, an increase in volume, and so forth caused by, for example, a change in temperature of an optical system.

Figure 20:
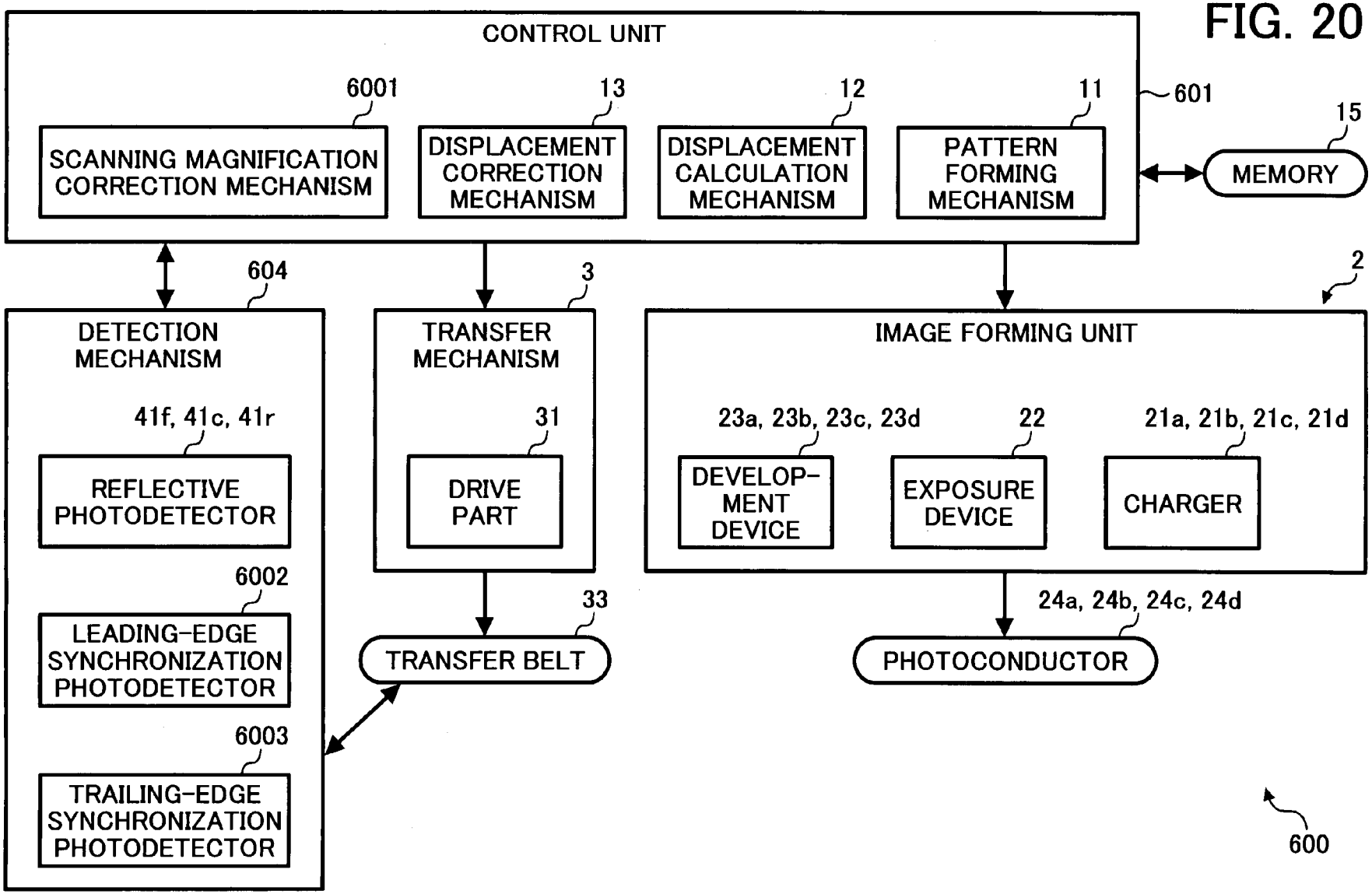
FIG. 20 is a functional block diagram of a color image forming apparatus according to another embodiment of the present invention.

FIG. 20 is a functional block diagram for explaining functions of a color image forming apparatus 600 according to the embodiment. As illustrated in FIG. 20, the color image forming apparatus 600 includes the same functional components as the functional components of the color image forming apparatus 100 except that the color image forming apparatus 600 has a control unit 601 and a detection mechanism 604 instead of the control unit 1 and the detection mechanism 4, respectively.

A configuration of the control unit 601 is the same as the configuration of the control unit 1 except that the control unit 601 further includes a scanning magnification correction mechanism 6001. A configuration of the detection mechanism 604 is the same as the configuration of the detection mechanism 4 except that the detection mechanism 604 further includes a leading-edge synchronization photodetector 6002 and a trailing-edge synchronization photodetector 6003. Functions of the scanning magnification correction mechanism 6001, the leading-edge synchronization photodetector 6002, and the trailing-edge synchronization photodetector 6003 are described later.

When the fluctuations in scanning magnification occur, the main scanning width is fluctuated when an image is formed, resulting in an adverse effect of lowered image quality. In the embodiment, the fluctuations in scanning magnification is corrected before the pattern for measurement is formed and displacement is corrected both in the fine adjustment mode and the rough adjustment mode so that the pattern is precisely formed to enhance accuracy in the correction of displacement.

Figures 21, 21A:
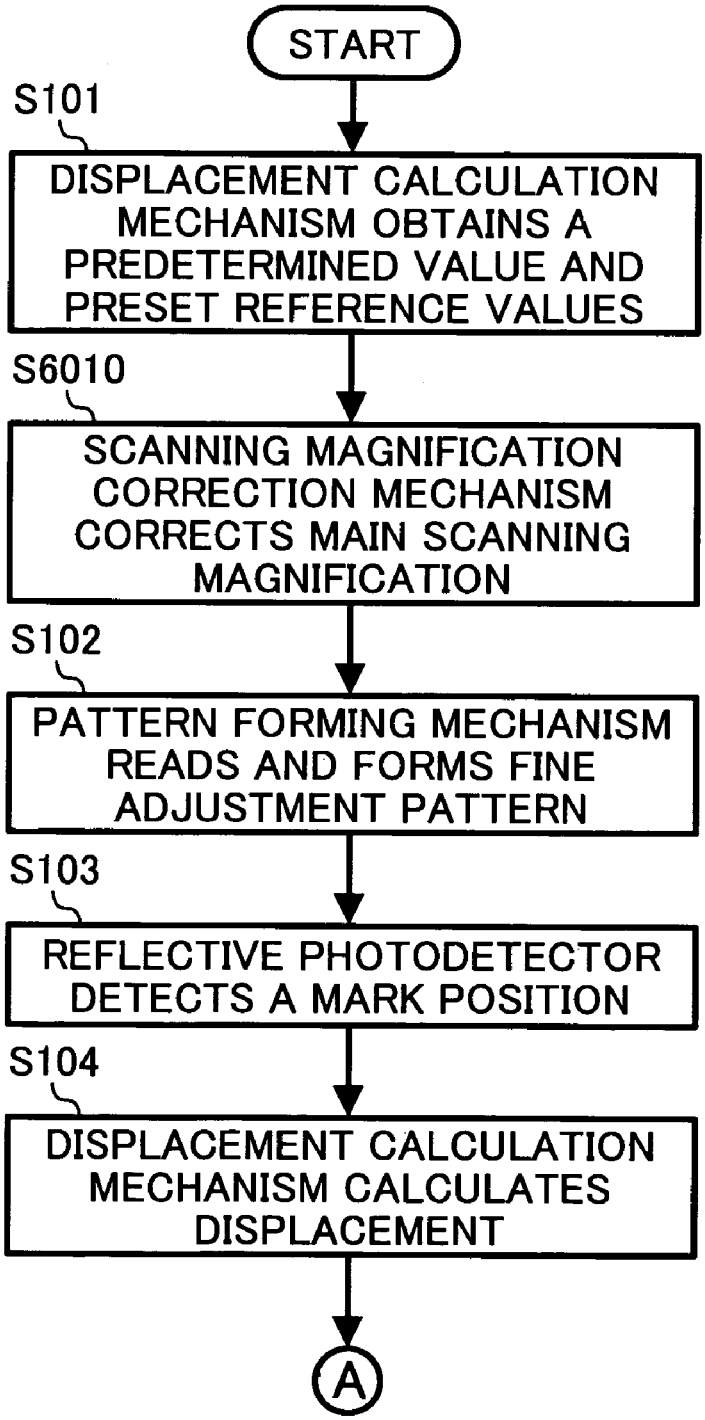
FIG. 21 is a flowchart for explaining an example procedure of color registration adjustment performed by the color image forming apparatus in FIG. 20.
Figure 21B:
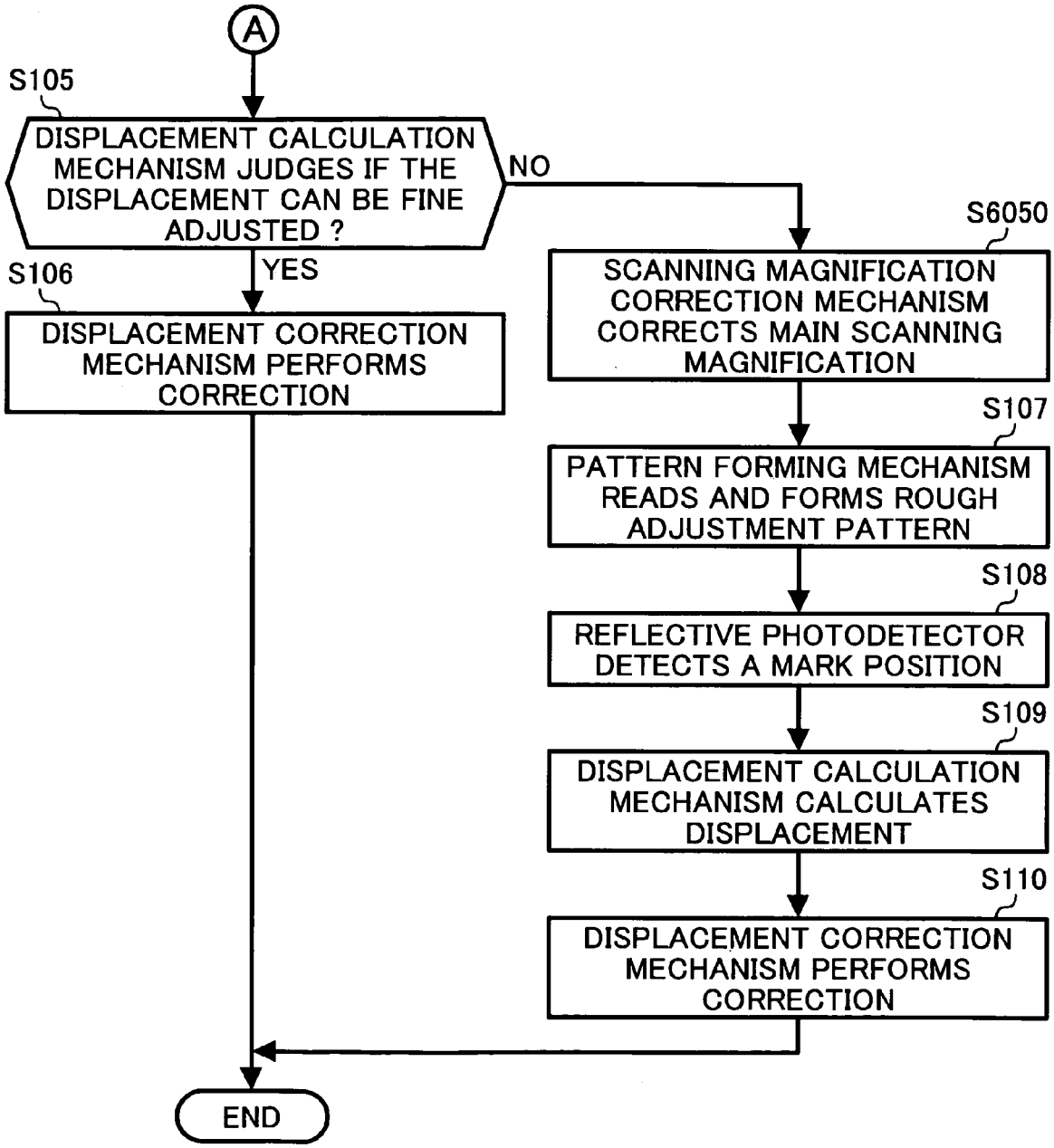

FIG. 21 is a flowchart for explaining an example procedure of color registration adjustment performed by the image forming apparatus 600. Since the steps S101 to S110 are the same as the steps S101 to S110 in the procedure of the color image forming apparatus 100 in FIG. 12, description thereof is omitted. A difference between the flows of the procedures of the color image forming apparatus 600 and the color image forming apparatus 100 is that the scanning magnification correction mechanism 6001 corrects the scanning magnification in the main scanning direction in steps S6010 and S6050 before the pattern forming mechanism reads and forms the pattern for measurement in steps S102 and S107, respectively, as illustrated in FIG. 21.

Figure 22:
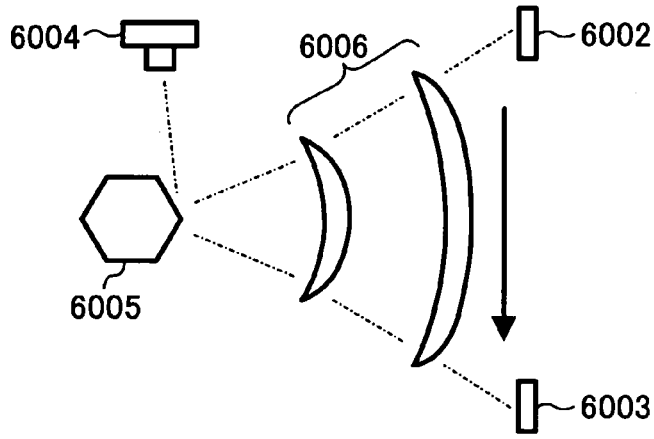
FIG. 22 is a schematic diagram illustrating a configuration of a detection mechanism in FIG. 20.

FIG. 22 schematically illustrates a configuration of the detection mechanism 604. The detection mechanism 604 includes an LD unit 6004, a polygon 6005, a polygon motor (not shown), an optical system (not shown) having an fθ lens set 6006, the leading-edge synchronization photodetector 6002, and the trailing-edge synchronization photodetector 6003. Flux of light emitted from the LD unit 6004 passes through the optical system. The flux of light then is shone on a wall surface of the polygon 6005 rotated by a polygon motor (not shown), and reflected therefrom. As the polygon 6005 rotates, the reflected flux of light moves in the main scanning direction.

Figure 23:
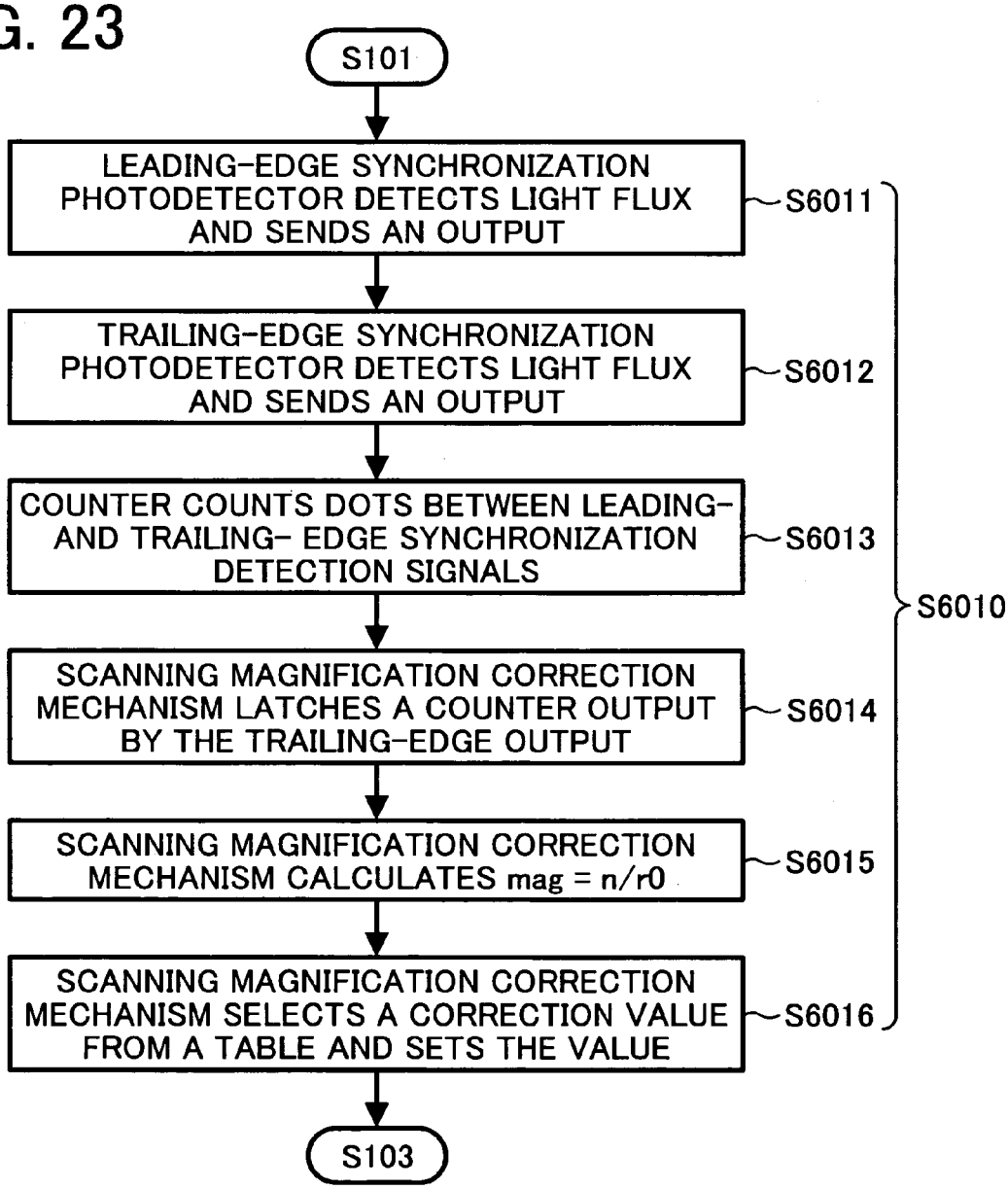
FIG. 23 is a flowchart explaining the details of a step of correcting scanning magnification in the main scanning direction included in the color registration adjustment in FIG. 21.

FIG. 23 is a flowchart explaining the details of step S6010 in FIG. 21. The moving flux of light is firstly detected by the leading-edge synchronization photodetector 6002. After detecting the flux of light, the leading-edge synchronization photodetector 6002 sends a leading-edge synchronization detection output signal to the scanning magnification correction mechanism 6001 (step S6011). The moving flux of light is secondly detected by the trailing-edge synchronization photodetector 6003. After detecting the flux of light, the trailing-edge synchronization photodetector 6003 sends a trailing-edge synchronization detection output signal to the scanning magnification correction mechanism 6001 (step S6012).

Figure 24:
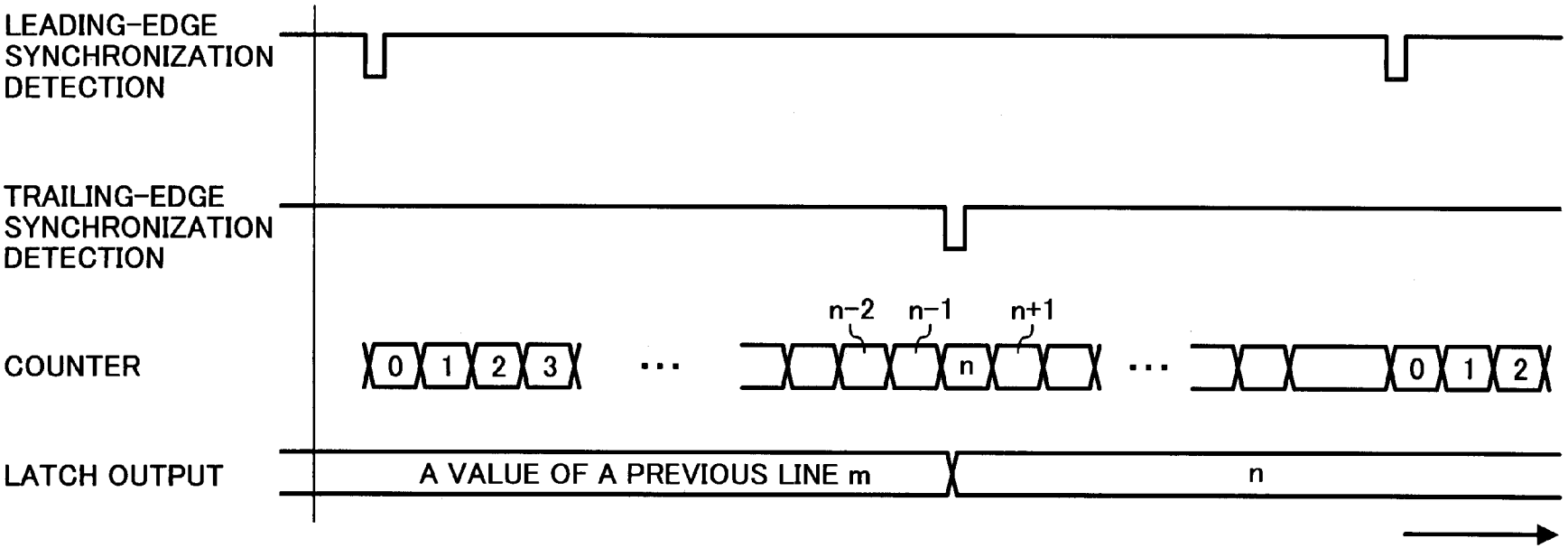
FIG. 24 is a time chart for explaining how a counter output is latched.

FIG. 24 is a time chart for explaining how a counter output is latched. In the scanning magnification correction mechanism 6001, a counter (not shown) counts dots between the leading-edge synchronization detection output signal and the trailing-edge synchronization detection output signal by the number of clock signals (step S6013). Then, the scanning magnification correction mechanism 6001 latches a counter output by using the trailing-edge synchronization detection output signal (step S6014).

When a value of the latched counter output is "n", the scanning magnification correction mechanism 6001 calculates a value of "mag", where "mag" represents a ratio of the counter output to a reference value (n/r0) (step S6015). The scanning magnification correction mechanism 6001 compares the value of "mag" with a reference range. When the value of "mag" is out of the reference range, the scanning magnification correction mechanism 6001 reads correction value data stored in a comparison table, corrects a clock frequency, and sets the corrected clock frequency (step S6016). The correction of the clock frequency can be made by using a known technology such as a phase locked loop (LLP) technology and a frequency divider.

The same correction operation as described above is also performed before reading the pattern for rough adjustment to perform the correction of displacement in the rough adjustment mode (step S6050). A description of step S6050 is omitted as the description is the same as the description of step S6010.

It is preferable in the color image forming apparatuses according to the previous embodiments that the scanning magnification correction be certainly performed immediately before reading any one of the patterns for the fine adjustment and the rough adjustment. Performing the scanning magnification correction before forming the pattern for measurement results in enhanced accuracy in the formation of the patterns.

Further, in a case the pattern for measurement is formed both in the main scanning direction and the sub-scanning direction, the scanning magnification correction is preferably performed first. The pattern for measurement in the main scanning direction is preferably formed immediately after the scanning magnification correction, and the pattern for measurement in the sub-scanning direction is preferably formed thereafter.

As a result, precision in scanning in the main direction is improved, and an image with high image quality can be formed.

Figure 25:
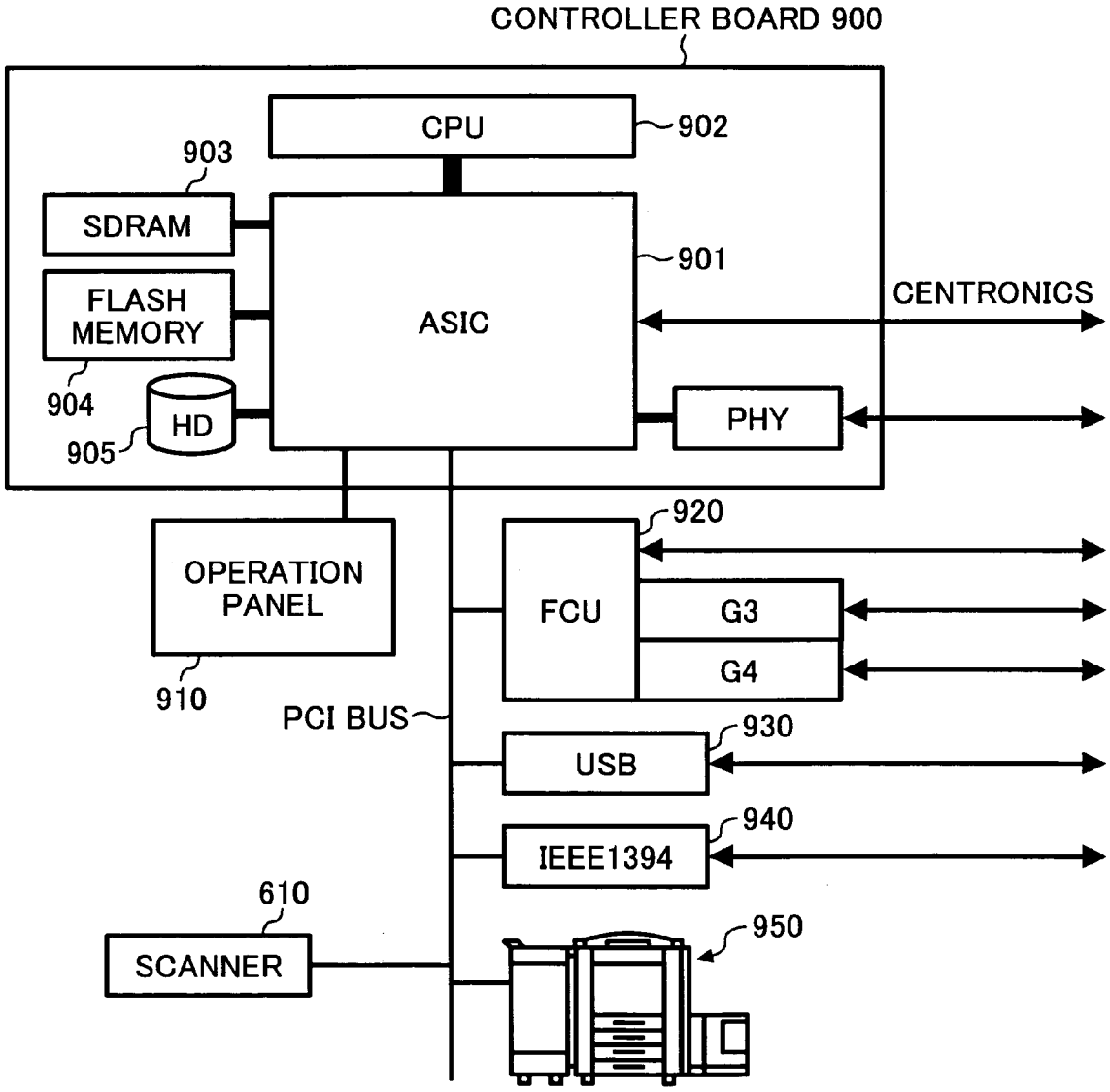
FIG. 25 is a schematic diagram illustrating an example general configuration of a network including the color image forming apparatus in FIG. 20.

FIG. 25 is a schematic diagram illustrating an example general configuration of a net work including the color image forming apparatus 600 according to the embodiments of the present invention. The following description applies to the color image forming apparatuses 100 to 500 according to the previous embodiments. As illustrated in FIG. 25, the color image forming apparatuses 600 generally includes a system control part 900 being a controller board having a central processing unit (CPU) 902, an SDRAM 903, a flash memory 904, a hard disk (HD) 905, and so forth connected to ASIC 901 thereon, and an operation panel 910. The net work generally includes a fax control unit (FCU) 920, USB 930, IEEE1394 904, a printer 950, and a scanner 610.

The operation panel 910 is directly connected to the ASIC 901, and the FCU 920, the USB 930, the IEEE1394 940, the printer 950, and the scanner 504 are connected to the ASIC 901 via a PCI bus.

The HD 905 stores an image forming program for causing the CPU 902 in the color image forming apparatus to perform the above-mentioned steps and functions. The image forming program to be executed by the color image forming apparatus may be provided in a form of a file in an installable format or in an executable format recorded on a computer-readable recording medium such as a CD-ROM, a flexible disk (FD), a CD-R, and a DVD (digital versatile disk). In the case, the CPU 902 reads the image forming program from the recording medium to load onto a main memory device, thereby causing the color image forming apparatus to execute the above-described steps and functions.

The color image forming program has a module structure. Each of the above-mentioned parts in the color image forming program including the pattern forming mechanism, the displacement calculation mechanism, the displacement correction mechanism, the scanning magnification correction mechanism, and the system control part 900 takes a form of a module. In detail, when the modules are read and executed by the CPU 902, the parts are loaded onto the main memory device, and generated thereon.

The image forming program may be stored in a computer connected to a network such as the Internet, and provided via the network through a download operation. Alternatively, the image forming program may be provided or distributed via a network such as the Internet.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent applications, No. JPAP2004-348702 filed on Dec. 1, 2004, No. JPAP2005-002621 filed on Jan. 7, 2005, and No. 2005-253577 filed on Sep. 1, 2005, in the Japanese Patent Office, the entire contents of which are incorporated by reference herein.

What is claimed as new and desired to be secured by Letters Patent of the United States is:

1. A color image forming apparatus, comprising:

an image forming unit configured to form a latent image for each of a plurality of colors by scanning a corresponding photoconductor with a light beam based on an input image, and to develop the latent image into a color toner image in the corresponding color;

a transfer mechanism configured to transfer the color toner image in turn onto a transfer medium to form a color image in the plurality of colors;

a pattern forming mechanism configured to control the image forming unit to form a first pattern for color registration adjustment, and to form a second pattern for color registration adjustment when requested, wherein each of the first and second patterns includes at least a set of marks each corresponding to one of the plurality of colors, arranged in parallel to each other, and the marks in the first and second patterns are formed at a predetermined interval and at a longer interval than the predetermined interval, respectively, as the pattern forming mechanism forms the marks in different time intervals between the first and second patterns;

a detection mechanism configured to detect the marks in the first and second patterns;

a displacement calculation mechanism configured to obtain a predetermined value and preset reference values, to calculate an amount of displacement of each of the detected marks in the first and second patterns based on the corresponding preset reference values, to determine whether or not the amount of the displacement is equal to or less than the predetermined value when the amount of the displacement is measured by using the first pattern, wherein the displacement calculation mechanism requests the pattern forming mechanism to form the second pattern when the amount of the displacement is larger than the predetermined value, and a displacement correction mechanism configured to control the image forming unit to correct the displacement based on the amount of the displacement by forming a latent image so as to offset the amount of the displacement.

2. The color image forming apparatus according to claim 1, wherein the displacement correction mechanism corrects the displacement in at least one of a main scanning direction and a sub-scanning direction, and the pattern forming mechanism is further configured to form the marks arranged at least one of in parallel to the main scanning direction and at a predetermined angle in the main scanning direction, wherein when the pattern forming mechanism forms the marks arranged in parallel to the main scanning direction, the displacement correction mechanism corrects the displacement in the sub-scanning direction, and when the pattern forming mechanism forms the marks arranged at the predetermined angle in the main scanning direction, the displacement correction mechanism corrects the displacement in the main scanning direction.

3. The color image forming apparatus according to claim 1, wherein the transfer medium includes a transfer belt, and the detection mechanism comprises a photodetector for detecting the mark in each of the plurality of colors in the first and second patterns formed on the transfer belt.

4. The color image forming apparatus according to claim 3, further comprising a plurality of photodetectors for detecting light beam scanning in a main scanning direction, and a scanning magnification correction mechanism for measuring a number of dots in image data in each of the plurality of colors between the plurality of photodetectors based on a result of detection of the light beam performed by the plurality of photodetectors, comparing the measured number of dots with a preset reference value, and correcting fluctuations in scanning magnification comprising fluctuations in a scanning width of the light beam in the main scanning direction, wherein the pattern forming mechanism forms the marks in the first and second patterns based on the corrected scanning magnification by the scanning magnification correction mechanism.

5. The color image forming apparatus according to claim 4, wherein the pattern forming mechanism forms the marks arranged at the predetermined angle after the photodetectors detect the light beam and the scanning magnification correction mechanism corrects the scanning magnification based on the corrected scanning magnification when the marks arranged at the predetermined angle are to be formed.

6. The color image forming apparatus according to claim 5, wherein the displacement calculation mechanism calculates the amount of the displacement after the scanning magnification correction mechanism corrects the scanning magnification, the pattern forming mechanism forms the marks arranged at the predetermined angle, and the marks arranged in parallel to the main scanning direction when the marks arranged at the predetermined angle and the marks arranged in parallel to the main scanning direction are to be formed by the pattern forming mechanism.

7. The color image forming apparatus according to claim 1, wherein the transfer medium includes an intermediate transfer belt, and the detection mechanism comprises a photodetector for detecting the mark in each of the plurality of colors in the first and second patterns formed on the intermediate transfer belt.

8. The color image forming apparatus according to claim 1, wherein the color registration adjustment mechanism is further configured to perform adjustment by using the first pattern when adjustment is performed by using the second pattern.

9. The color image forming apparatus according to claim 1, wherein the transfer medium includes a transfer sheet, and the detection mechanism comprises a photodetector for detecting the mark in each of the plurality of colors in the first and second patterns formed on the transfer sheet.

10. The color image forming apparatus according to claim 1, wherein the transfer medium includes a transfer sheet, and the detection mechanism comprises a scanner for detecting the mark in each of the plurality of colors in the first and second patterns formed on the transfer sheet.

11. A color image forming method, comprising the steps of:

obtaining a predetermined value and preset reference values;

forming a pattern including at least a set of marks for adjusting color registration in a first mode and a second mode, wherein the pattern forming step comprises the sub-steps of:

forming a latent image of each of the marks for each of a plurality of colors by scanning a corresponding photoconductor with a light beam based on an input image;

developing the latent image into a color toner image in the corresponding color; and transferring the color toner image in turn onto a transfer medium to form a color image in the plurality of colors; and adjusting color registration in the first and second modes, wherein the pattern forming step forms a first pattern and a second pattern, each including at least the set of marks in the first and second modes, respectively, wherein the marks in the first pattern are formed at a predetermined interval in the first mode, and the marks in the second pattern are formed at a longer interval than the predetermined interval in the second mode when requested, as the marks are formed in different time intervals between the first and second patterns; and adjusting color registration in the first and second modes, comprises the sub-steps of:

detecting the marks in the first and second patterns by using a detection device in the first and second modes, respectively;

calculating an amount of displacement of each of the detected marks in the first and second patterns based on the corresponding preset reference values in the first and second modes, respectively;

determining whether or not the amount of the displacement is equal to or less than the predetermined value in the first mode, wherein forming of the second pattern in the second mode is requested when the amount of the displacement is larger than the predetermined value; and correcting the displacement based on the amount of the displacement by forming a latent image so as to offset the amount of the displacement in the first and second modes.

12. The color image forming method according to claim 11, wherein the displacement correcting step corrects the displacement in at least one of a main scanning direction and a sub-scanning direction, and the pattern forming step forms the marks arranged at least one of in parallel to the main scanning direction and at a predetermined angle in the main scanning direction, wherein when the pattern forming step forms the marks arranged in parallel to the main scanning direction, the displacement in the sub-scanning direction is corrected, and when the pattern forming step forms the marks arranged at the predetermined angle in the main scanning direction, the displacement in the main scanning direction is corrected.

13. The color image forming method according to claim 11, wherein the pattern forming step forms the mark on one of a transfer belt, an intermediate transfer belt, and a transfer sheet, and the detecting step detects the mark by using a photodetector when the mark is formed on one of the transfer belt and the intermediate transfer belt, and by using one of the photoconductor and a scanner when the mark is formed on the transfer sheet.

14. The color image forming method according to claim 13, further comprising the steps of:

detecting the light beam scanning in the main scanning direction by using a plurality of photodetectors; and correcting fluctuations in which a number of dots in image data in each of the plurality of colors between the plurality of photodetectors is measured based on a result of detection of the light beam, the measured number of dots is compared with a reference value, and scanning magnification being fluctuations in a scanning width of the light beam in the main scanning direction is corrected.

15. The color image forming method according to claim 14, wherein when the pattern forming step is to form the marks arranged at the predetermined angle, the steps of detecting the light beam and correcting fluctuations are performed before the marks arranged at the predetermined angle are formed.

16. The color image forming method according to claim 15, wherein when the pattern forming step is to successionally form the marks arranged at the predetermined angle and the marks arranged in parallel to the main scanning direction, the scanning magnification correcting step corrects the scanning magnification, and the steps of detecting the light beam and correcting fluctuations are performed before the marks arranged at the predetermined angle and the marks arranged in parallel to the main scanning direction are formed.

17. The color image forming method according to claim 11, wherein when the color registration adjusting step is performed in the second mode, the color registration adjusting step is performed in the first mode.

18. A computer program product stored on a computer readable storage medium, comprising the step of:

causing a color image forming apparatus comprising:

an image forming mechanism configured to form latent images for a plurality of colors separated from an input image, and to develop the latent images into respective color toner images, and to transfer the respective color toner images in turn onto a transfer medium to form an overlaid color image;

an error detecting mechanism configured to detect a color registration error in the overlaid color image; and an error adjusting mechanism configured to perform comparison between the color registration error and a predetermined value to instruct, in accordance with a result of the comparison, the image forming mechanism to selectively perform one of fine and rough color registration adjustments when forming the latent images, to perform a color image forming method comprising the steps of:

obtaining a predetermined value and preset reference values;

forming a pattern including at least a set of marks for adjusting color registration in a first mode and a second mode, wherein the pattern forming step comprises the sub-steps of:

forming a latent image of each of the marks for each of a plurality of colors by scanning a corresponding photoconductor with a light beam based on an input image;

developing the latent image into a color toner image in the corresponding color; and transferring the color toner image in turn onto a transfer medium to form a color image in the plurality of colors; and adjusting color registration in the first and second modes.

* * * * *